US012796774B2

(12) United States Patent
Case et al.

(10) Patent No.: US 12,796,774 B2
(45) Date of Patent: Nov. 17, 2026

(54) CUSHIONING COMPONENT FOR A WEARABLE ARTICLE AND METHOD OF MANUFACTURING SAME

(71) Applicant: NIKE, Inc., Beaverton, OR (US)

(72) Inventors: Patrick R. Case, Beaverton, OR (US); Tory M. Cross, Portland, OR (US); Viviane Labelle, Portland, OR (US); Yuan Mu, Portland, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/974,991

(22) Filed: Dec. 10, 2024

(65) Prior Publication Data

US 2025/0194743 A1 Jun. 19, 2025

Related U.S. Application Data

(60) Provisional application No. 63/610,446, filed on Dec. 15, 2023.

(51) Int. Cl.
*A43B 13/20* (2006.01)

(52) U.S. Cl.
CPC ..... *A43B 13/20* (2013.01)

(58) Field of Classification Search
CPC ..... A43B 13/04; A43B 13/20; A43B 13/125
See application file for complete search history.

(56) References Cited

U.S. PATENT DOCUMENTS 2,968,105 A * 1/1961 Rizzo ..... A43B 13/20 36/77 R
4,183,156 A 1/1980 Rudy
4,219,945 A * 9/1980 Rudy ..... A43B 13/203 36/44
4,774,774 A * 10/1988 Allen, Jr. ..... A43B 13/20 36/28
4,936,029 A 6/1990 Rudy
(Continued)

FOREIGN PATENT DOCUMENTS

CN 115153151 A 10/2022
TW 200601993 A 1/2006
(Continued)

*Primary Examiner* — Bao-Thieu L Nguyen
(74) *Attorney, Agent, or Firm* — Shook, Hardy & Bacon L.L.P.

(57) ABSTRACT

A cushioning component includes a bladder and a core. The bladder includes first and second barrier sheets defining an interior cavity between opposing inner surfaces of the barrier sheets. The core includes at least one polymeric sheet traversing the interior cavity between and directly bonded to the opposing inner surfaces at a plurality of bonds. The cushioning component includes a sidewall disposed around an outer perimeter of the core and directly bonded to the first and second barrier sheets at peripheral bonds to enclose the interior cavity. The core is disposed in the interior cavity and is decoupled from the sidewall. A method of manufacturing includes disposing blocker ink on opposing sides of at least one polymeric sheet, placing the at least one polymeric sheet between the barrier sheets, and thermally bonding the core to the opposing inner surfaces, and the sidewall to the barrier sheets at the peripheral bonds.

20 Claims, 15 Drawing Sheets

(56) References Cited

U.S. PATENT DOCUMENTS 5,042,176 A * 8/1991 Rudy ..... F16F 1/3615 36/153
5,337,492 A * 8/1994 Anderie ..... A43B 13/181 36/114
5,713,141 A 2/1998 Mitchell et al.
5,755,001 A 5/1998 Potter et al.
5,930,918 A * 8/1999 Healy ..... A43B 13/20 36/35 B
5,952,065 A 9/1999 Mitchell et al.
6,013,340 A 1/2000 Bonk et al.
6,082,025 A 7/2000 Bonk et al.
6,127,026 A 10/2000 Bonk et al.
6,203,868 B1 3/2001 Bonk et al.
6,321,465 B1 11/2001 Bonk et al.
8,479,412 B2 7/2013 Peyton et al.
9,187,256 B2 * 11/2015 Iwasaka ..... B65G 25/00
10,362,833 B2 7/2019 Campos, II et al.
10,694,814 B2 * 6/2020 Bailey ..... B32B 7/05
11,213,094 B2 1/2022 Case et al.
11,219,271 B2 1/2022 Auyang et al.
2002/0139471 A1 10/2002 Tawney et al.
2010/0107445 A1 * 5/2010 Aveni ..... A43B 13/189 36/35 B
2011/0277347 A1 11/2011 Monfils et al.
2012/0174432 A1 * 7/2012 Peyton ..... A43B 13/125 36/31
2012/0260524 A1 * 10/2012 Izquieta Anaut .... A43B 13/181 12/146 B
2013/0276329 A1 * 10/2013 James ..... A43B 17/026 36/83
2014/0053427 A1 2/2014 Patton
2014/0115925 A1 * 5/2014 Hurd ..... A43B 13/125 156/182
2015/0013190 A1 * 1/2015 Davison ..... A43B 13/186 36/102
2015/0113829 A1 * 4/2015 Kodad ..... A43B 13/141 383/105
2017/0042286 A1 * 2/2017 Meschter ..... A43B 13/189
2018/0213886 A1 * 8/2018 Connell ..... A43B 13/186
2018/0332925 A1 * 11/2018 Bailey ..... B32B 27/08
2018/0338577 A1 * 11/2018 Elder ..... A43B 3/0057
2018/0338578 A1 11/2018 Elder et al.
2019/0062614 A1 * 2/2019 Steinbeck ..... C09K 5/063
2019/0365036 A1 * 12/2019 Meeker ..... A43B 13/20
2020/0154826 A1 5/2020 Case et al.
2020/0375307 A1 * 12/2020 Hurd ..... A43B 7/1485
2021/0353001 A1 * 11/2021 Elder ..... A43B 13/127
2021/0368920 A1 12/2021 Elder et al.
2021/0368921 A1 * 12/2021 Campos, II ..... A43B 13/125
2021/0368923 A1 * 12/2021 Seid ..... A43B 13/187
2022/0202137 A1 * 6/2022 Kiss ..... A43B 13/20
2024/0206591 A1 * 6/2024 Case ..... A43B 13/20
2025/0194740 A1 * 6/2025 Case ..... A43B 13/125
2025/0194744 A1 * 6/2025 Case ..... A43B 13/20
2025/0318601 A1 * 10/2025 Case ..... A43B 13/125

FOREIGN PATENT DOCUMENTS

TW 202027639 A 8/2020
TW 202126208 A 7/2021
WO 0170060 A2 9/2001

* cited by examiner

CUSHIONING COMPONENT FOR A WEARABLE ARTICLE AND METHOD OF MANUFACTURING SAME

CROSS-REFERENCE TO RELATED APPLICATION

This application claims the benefit of priority to U.S. Provisional Application No. 63/610,446, filed Dec. 15, 2023 which is incorporated by reference in its entirety.

TECHNICAL FIELD

The present disclosure generally relates to a cushioning component for a wearable article, including a bladder and a core of at least one polymeric sheet disposed in the bladder, as well as to a method of manufacturing the cushioning component.

BACKGROUND

Wearable articles, such as articles of footwear, often include cushioning components. Some cushioning components are configured as fluid-filled bladders that enclose an interior cavity to retain a gas in the interior cavity, providing cushioning when loaded.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figures 1, 2, 3:
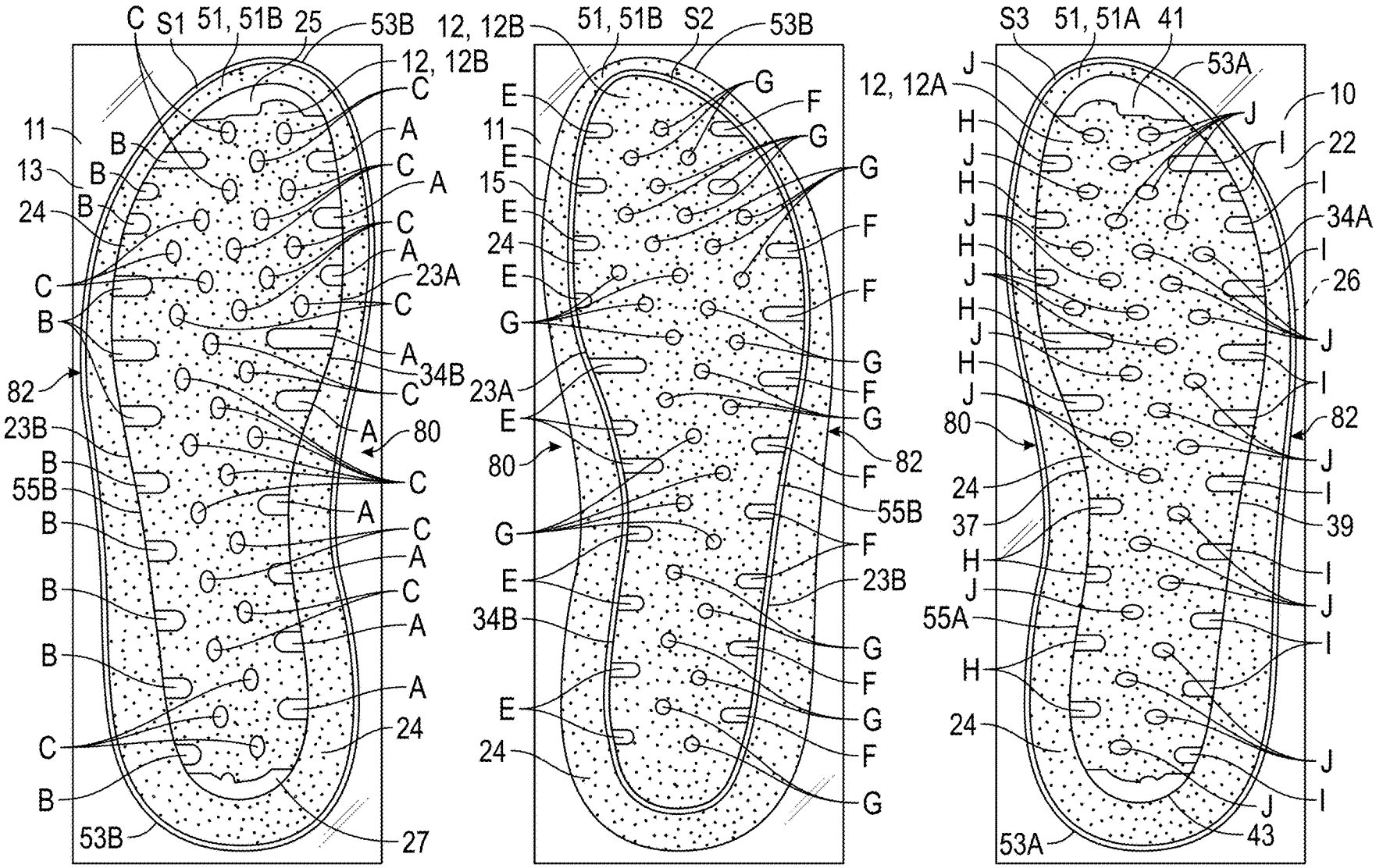
FIG. 1 is a plan view of a bottom side of a polymeric sheet with anti-weld material disposed thereon.
FIG. 2 is a plan view of an opposing top side of the polymeric sheet of FIG. 1 with anti-weld material disposed thereon in a different pattern than on the side shown in FIG. 1.
FIG. 3 is a plan view of a top side of another polymeric sheet with anti-weld material disposed thereon and with an opposite second side not having any anti-weld material disposed thereon.

The present disclosure generally relates to a cushioning component for a wearable article that includes a bladder and a core. The bladder includes a first barrier sheet and a second barrier sheet that define an interior cavity between opposing inner surfaces of the first barrier sheet and the second barrier sheet. The core includes at least one polymeric sheet traversing the interior cavity between and directly bonded to the opposing inner surfaces of the first barrier sheet and the second barrier sheet at a plurality of bonds to tether the first barrier sheet to the second barrier sheet. The cushioning component further includes a sidewall comprising at least one polymeric sheet disposed around an outer perimeter of the core and directly bonded to the first barrier sheet at a first peripheral bond and to the second barrier sheet at a second peripheral bond to enclose the interior cavity and retain a gas in the interior cavity. The at least one polymeric sheet of the core is disposed in the interior cavity and is decoupled from the sidewall. The core is displaced from the opposing inner surfaces by gas at unbonded areas of the at least one polymeric sheet.

In an implementation, the plurality of bonds may be arranged such that the gas in the interior cavity is in fluid communication around the core without the core creating any sealed chambers within the bladder that are not in fluid communication with the interior cavity.

In an example, the sidewall is a single polymeric sheet. In such an implementation, the sidewall may be in a first position when the interior cavity is in an uninflated state and in a second position when the when the interior cavity is in an inflated state. The sidewall may be relatively folded inward toward the core in the first position and may extend relatively vertically around the interior cavity in the second position.

In an implementation, the wearable article may be an article of footwear, and the cushioning component may be included in a sole structure of the article of footwear. In an example in which the sidewall is a single polymeric sheet, the cushioning component may extend in each of a heel region, a midfoot region, and a forefoot region of the article of footwear, and the sidewall may have a greater height in the heel region than in the forefoot region.

In an aspect, the interior cavity may be a first interior cavity, and the cushioning component may also include a third barrier sheet bonded to the second barrier sheet at an additional peripheral bond. The second barrier sheet and the third barrier sheet may define a second interior cavity between an outer surface of the second barrier sheet and an inner surface of the third barrier sheet. The first interior cavity and the second interior cavity may be fluidly isolated from one another by the second barrier sheet.

In an implementation, the third barrier sheet may be disposed at a distal side of the cushioning component and the first barrier sheet may be disposed at a foot-facing side of the cushioning component. An inflation pressure of the second interior cavity may be different than an inflation pressure of the first interior cavity. For example, the inflation pressure of the first interior cavity may be less than that of the second interior cavity to provide a softer feel at the wearer's foot. In this manner, the first barrier sheet may provide a footbed while the third barrier sheet enables the ground-facing surface to be relatively flat.

In an example, the third barrier sheet may be disposed at a distal side of the cushioning component and the first barrier sheet may be disposed at a foot-facing side of the cushioning component. The core may tether the first barrier sheet to the second barrier sheet such that a vertical height of the bladder at the core is less than a vertical height of the bladder at the sidewall. A resulting concavity at an outer surface of the first barrier sheet may serve as at least a portion of a footbed, and there may also be a concavity at the outer surface of the second barrier sheet. The third barrier sheet may be relatively flat in comparison to the second barrier sheet opposite from the concavity of the second barrier sheet.

In another implementation, the core may include more than one polymeric sheet. For example, the at least one polymeric sheet of the core may include a first polymeric sheet and a second polymeric sheet, with the first polymeric sheet disposed between the first barrier sheet and the second polymeric sheet, and the second polymeric sheet disposed between the first polymeric sheet and the second barrier sheet such that a first side of the first polymeric sheet of the core faces the inner surface of the first barrier sheet, a second side of the first polymeric sheet of the core faces a first side of the second polymeric sheet, and a second side of the second polymeric sheet of the core faces the inner surface of the second barrier sheet. The at least one polymeric sheet of the sidewall may likewise include a first polymeric sheet and a second polymeric sheet. The first polymeric sheet of the sidewall may be bonded to the first barrier sheet at the first peripheral bond, the second polymeric sheet of the sidewall may be bonded to the second barrier sheet at the second peripheral bond, and the first polymeric sheet of the sidewall may be bonded to the second polymeric sheet of the sidewall at a third peripheral bond disposed along the sidewall between the first peripheral bond and the second peripheral bond.

In one or more such implementations, the first side of the first polymeric sheet of the core may be directly bonded to the inner surface of the first barrier sheet at a first set of bonds of the plurality of bonds, the second side of the second polymeric sheet of the core may be directly bonded to the inner surface of the second barrier sheet at a second set of bonds of the plurality of bonds, and the second side of the first polymeric sheet of the core may be directly bonded to the first side of the second polymeric sheet of the core at a third set of bonds of the plurality of bonds.

In such an example, the sidewall may be in a first position when the interior cavity is in an uninflated state and in a second position when the interior cavity is in an inflated state. In the second position, the first polymeric sheet of the sidewall and the second polymeric sheet of the sidewall may extend relatively vertically between the first barrier sheet and the second barrier sheet in comparison to the first position and with the third peripheral bond extending outward of the outer perimeter of the core and separated therefrom by a gap.

In an aspect, a cushioning component for a wearable article may include a bladder. The bladder may include a first barrier sheet and a second barrier sheet that define an interior cavity between opposing inner surfaces of the first barrier sheet and the second barrier sheet. The cushioning component may include a first polymeric sheet and a second polymeric sheet disposed between the first barrier sheet and the second barrier sheet. Each of the first polymeric sheet and the second polymeric sheet may include a core portion and a sidewall portion decoupled from the core portion and extending along an outer perimeter of the core portion. The core portion of the first polymeric sheet may be bonded to the inner surface of the first barrier sheet and to a first side of the core portion of the second polymeric sheet at a first plurality of bonds. The core portion of the second polymeric sheet may be bonded to the inner surface of the second barrier sheet at a second plurality of bonds and to a second side of the core portion of the first polymeric sheet at a third plurality of bonds. In this manner, the core portion of the first polymeric sheet and the core portion of the second polymeric sheet together traverse the interior cavity and tether the first barrier sheet to the second barrier sheet. The sidewall portion of the first polymeric sheet may be bonded to the first barrier sheet at a first peripheral bond. The sidewall portion of the second polymeric sheet may be bonded to the second barrier sheet at a second peripheral bond. The sidewall portion of the first polymeric sheet and the sidewall portion of the second polymeric sheet may be bonded to one another at a third peripheral bond such that the sidewall portions and the first and second barrier sheets together enclose the interior cavity and retain a gas in the interior cavity. The first polymeric sheet of the core portion and the second polymeric sheet of the core portion may be displaced from the opposing inner surfaces of the first barrier sheet and the second barrier sheet by the gas at unbonded areas of the core portion of the first polymeric sheet and the core portion of the second polymeric sheet.

In an implementation, the first plurality of bonds, the second plurality of bonds, and the third plurality of bonds may be arranged such that the gas in the interior cavity is in fluid communication around the core portions of the first and second polymeric sheets without the core portions creating any sealed chambers within the bladder that are not in fluid communication with the interior cavity.

In an aspect, the wearable article may be an article of footwear, and the cushioning component may be included in a sole structure of the article of footwear. For example, the cushioning component may extend in each of a heel region, a midfoot region, and a forefoot region of the article of footwear, and the sidewall portion may have a greater height in the heel region than in the forefoot region.

In an aspect, the interior cavity may be a first interior cavity, and the cushioning component may include a third barrier sheet bonded to the second barrier sheet at an additional peripheral bond. The second barrier sheet and the third barrier sheet may define a second interior cavity between an outer surface of the second barrier sheet and an inner surface of the third barrier sheet. The first interior cavity and the second interior cavity may be fluidly isolated from one another by the second barrier sheet. In one implementation, the third barrier sheet may be disposed at a distal side of the cushioning component and the first barrier sheet may be disposed at a foot-facing side of the cushioning component, and an inflation pressure of the second interior cavity may be different than an inflation pressure of the first interior cavity.

In an aspect, the third barrier sheet may be disposed at a distal side of the cushioning component and the first barrier sheet may be disposed at a foot-facing side of the cushioning component. The core portion may tether the first barrier sheet to the second barrier sheet such that a vertical height of the bladder at the core portion is less than a vertical height of the bladder at the sidewall portion. A concavity at an outer surface of the first barrier sheet may serve as at least a portion of a footbed. The third barrier sheet may be relatively flat in comparison to the second barrier sheet.

A method of manufacturing a cushioning component for a wearable article, such as that disclosed herein, may include disposing blocker ink on opposing first and second sides of at least one polymeric sheet, and placing the at least one polymeric sheet between a first barrier sheet and a second barrier sheet. The at least one polymeric sheet may include a core and a sidewall surrounding an outer perimeter of the core and decoupled from the core. The method may also include thermally bonding the core to opposing inner surfaces of the first barrier sheet and the second barrier sheet at a plurality of bonds at areas of the at least one polymeric sheet at which the blocker ink is not disposed to tether the first barrier sheet to the second barrier sheet, and also thermally bonding the sidewall to the first barrier sheet at a first peripheral bond and to the second barrier sheet at a second peripheral bond so that the sidewall and the barrier sheets enclose an interior cavity that extends between the opposing inner surfaces to define a bladder.

In an example, the method may include, prior to the thermal bonding, cutting a slot through the at least one polymeric sheet to decouple the core from the sidewall. An outer perimeter of the core may be defined by the slot and may be inward of the slot, and the sidewall may be outward of the slot.

In an aspect, placing the at least one polymeric sheet between the first barrier sheet and the second barrier sheet may include folding the sidewall with a fold extending inward toward the outer perimeter of the core.

In an implementation in which the wearable article is an article of footwear, the method may also include disposing the cushioning component in a sole structure of an article of footwear.

The above features and advantages and other features and advantages of the present teachings are readily apparent from the following detailed description of the modes for carrying out the present teachings when taken in connection with the accompanying drawings. It should be understood that, even though in the following the embodiments may be separately described, single features thereof may be combined in additional embodiments.

FIGS. 1-3 show polymeric sheets 10 and 11 used to form a core 12 and a sidewall 51 included with a bladder 20 in a cushioning component 14 shown in FIGS. 4-9. More specifically, the cushioning component 14 is included in a sole structure 70 of an article of footwear 72, as shown in FIG. 10. The sole structure 70 is shown secured to a footwear upper 75. The sole structure 70 also includes an outsole 73 secured to the distal side of the cushioning component 14 and providing a ground-engaging surface. The footwear upper 75 and the sole structure 70 are non-limiting. For example, foam midsole layers may also be included in the sole structure 70 overlying or underlying the cushioning component 14.

Each of the polymeric sheets 10 and 11 includes a core portion and a sidewall portion. Specifically, polymeric sheet 10 includes a core portion 12A and a sidewall portion 51A and polymeric sheet 11 includes a core portion 12B and a sidewall portion 51B. Accordingly, in the embodiment shown, the core 12 includes portions of two polymeric sheets 10 and 11 and the sidewall 51 includes different portions of the same two polymeric sheets 10 and 11. In other embodiments, the polymeric sheets used for the sidewall portions 51A and 51B could be different than the polymeric sheets used for the core 12. For example, if the material of the polymeric sheets 10 and 11 is different than the material of barrier sheets 16 and 18 included in the bladder 20, in some implementations, the sidewall portions 51A and 51B could be cut from different sheets than the polymeric sheets 10 and 11 and placed around the perimeters of the core portions 12A and 12B between the barrier sheets 16 and 18 prior to thermally processing the cushioning component 14.

The barrier sheets 16, 18 of the bladder 20 can be formed from a variety of materials including various polymers that can resiliently retain a fluid such as air or another gas. The polymeric sheets 10 and 11 may be formed of the same material or materials as the barrier sheets 16, 18 as described herein, or may be formed of a different polymeric material or materials. Because the sidewall portions 51A and 51B are formed from the polymeric sheets 10 and 11 that also form the core portions 12A and 12B, and the sidewall portions 51A and 51B form a portion of the exterior of the bladder 20, the material of the polymeric sheets 10 and 11, or at least the sidewall portions 51A and 51B thereof, is also a material that resiliently retains a fluid such as air or another gas.

Examples of polymeric materials for the barrier sheets 16, 18 and the polymeric sheets 10 and 11 can include thermoplastic urethane, polyurethane, polyester, polyester polyurethane, and polyether polyurethane. Moreover, the barrier sheets 16, 18 and the polymeric sheets 10 and 11 can be formed of layers of different materials. In one embodiment, the barrier sheets 16, 18 and/or the polymeric sheets 10 and 11 are formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. The barrier sheets 16, 18 and the polymeric sheets 10 and 11 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The barrier sheets 16, 18 and the polymeric sheets 10 and 11 may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the barrier sheets 16, 18 and the polymeric sheets 10 and 11 are disclosed in U.S. Pat. Nos. 4,183,156 and 4,219,945 to Rudy which are incorporated by reference in their entireties. Further suitable materials for the barrier sheets 16, 18 and the polymeric sheets 10 and 11 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the barrier sheets 16 and 18 and the polymeric sheets 10 and 11, engineering properties such as tensile strength, stretch properties, fatigue characteristics, dynamic modulus, and loss tangent can be considered. The thickness of the barrier sheets 16 and 18 and the polymeric sheets 10 and 11 can be selected to provide these characteristics.

As further explained herein with respect to FIGS. 5-8 for example, the cushioning component 14 includes the bladder 20 and the core 12 is disposed in the bladder 20 and bonded to inner surfaces 17, 19 of barrier sheets 16, 18 of the bladder 20 to act as a tensile component. Providing a tensile component within a bladder may be useful in restraining the bladder when inflated, preventing it from adopting a ball-like shape. A tensile component such as the core 12 according to the present disclosure enables bonding the polymeric sheets 10, 11 to the barrier sheets 16, 18 at bonds having patterns that result in technical advantages both in performance aspects of the cushioning component 14 and ease of manufacturing the cushioning component 14. Providing the sidewall portions 51A, 51B from the same polymeric sheets 10 and 11 as the core portions 12A and 12B enables a sidewall 51 with a more vertical orientation than if the barrier sheets 16 and 18 were directly bonded to one another at a peripheral bond to form a sidewall. Additionally, manufacturing may be simplified by disposing the anti-weld material 24 on the sidewall portions 51A and 51B at the same time as on the respective core portions 12A and 12B, cutting through the polymeric sheets 10 and 11 to decouple the sidewall portions 51A and 51B from the respective core portions 12A and 12B as discussed herein, and then disposing both the sidewall portions 51A and 51B and the core portions 12A and 12B between the barrier sheets 16 and 18 prior to thermal processing to form the various bonds.

Figure 5:
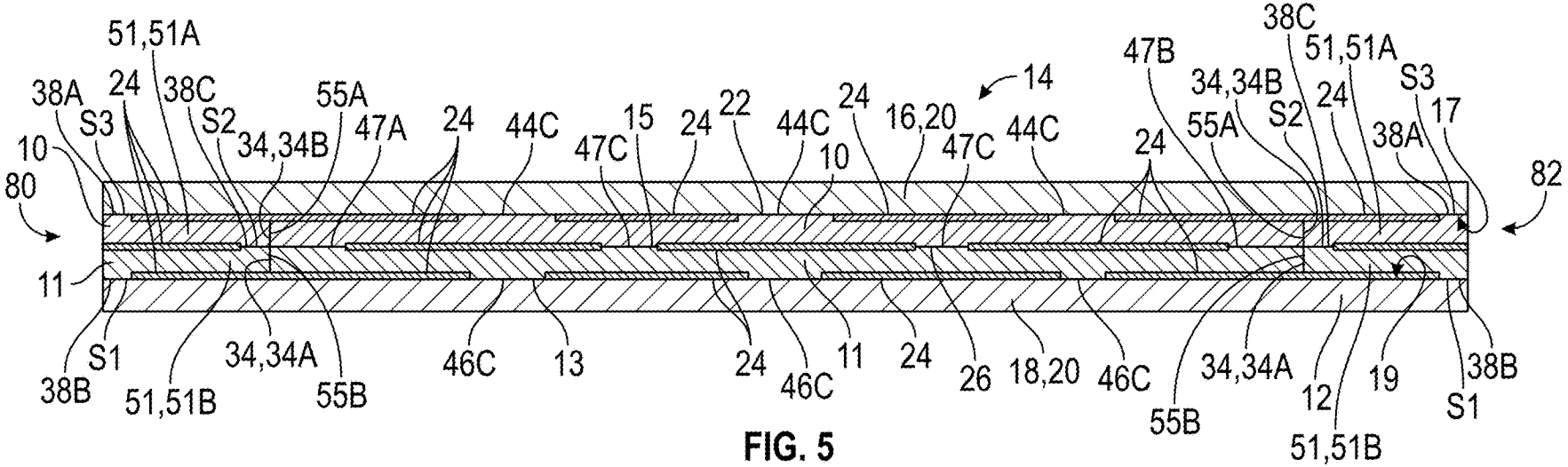
FIG. 5 is a cross-sectional view of the cushioning component of FIG. 4 taken at lines 5-5 in FIG. 4 in an uninflated state.
Figure 6:
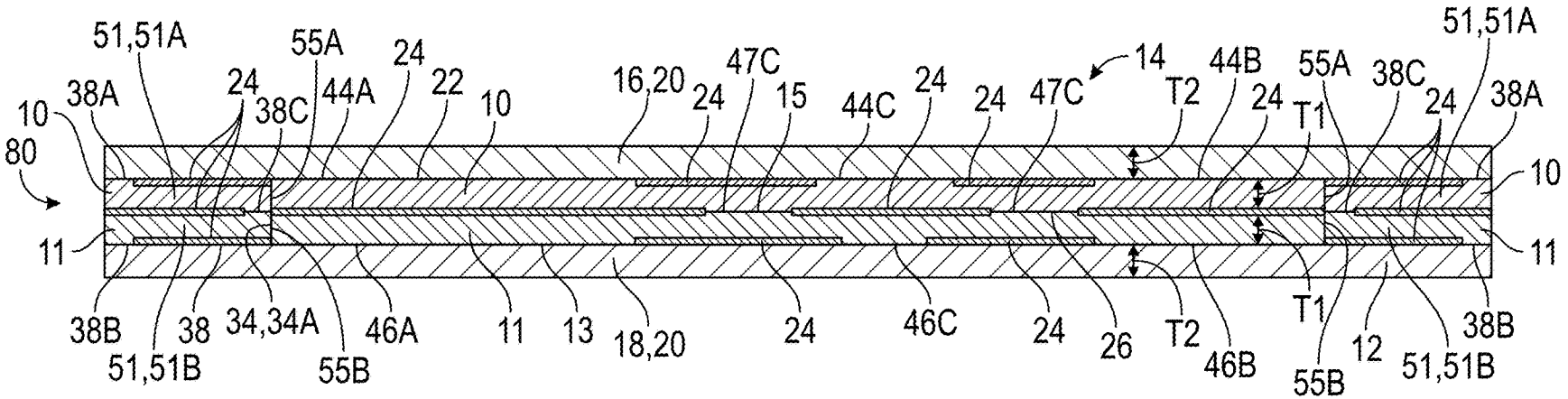
FIG. 6 is a cross-sectional view of the cushioning component of FIG. 4 taken at lines 6-6 in FIG. 4 in an uninflated state.

FIG. 1 is a plan view of a bottom side of the polymeric sheet 11 with anti-weld material 24 disposed thereon. The polymeric sheet 11 is referred to herein as a second polymeric sheet. The side of the polymeric sheet shown in FIG. 1 is a second side 13 and is also referred to as a bottom side or distal side as it is disposed further from the foot when the core 12 and sidewall 51 are incorporated in the sole structure 70 of the article of footwear 72. The second side 13 interfaces with and is bonded to the inner surface 19 of the second barrier sheet 18 as shown in FIGS. 5 and 6, for example, and discussed herein.

FIG. 2 is a plan view of an opposing first side 15 of the second polymeric sheet 11 with anti-weld material 24 disposed thereon in a different pattern than on the second side 13 shown in FIG. 1. The first side 15 is also referred to as the top side or the proximal side of the second polymeric sheet 11 as it is disposed closer to the foot when the core 12 and sidewall 51 are incorporated in the sole structure 70 of the article of footwear 72.

Figure 9:
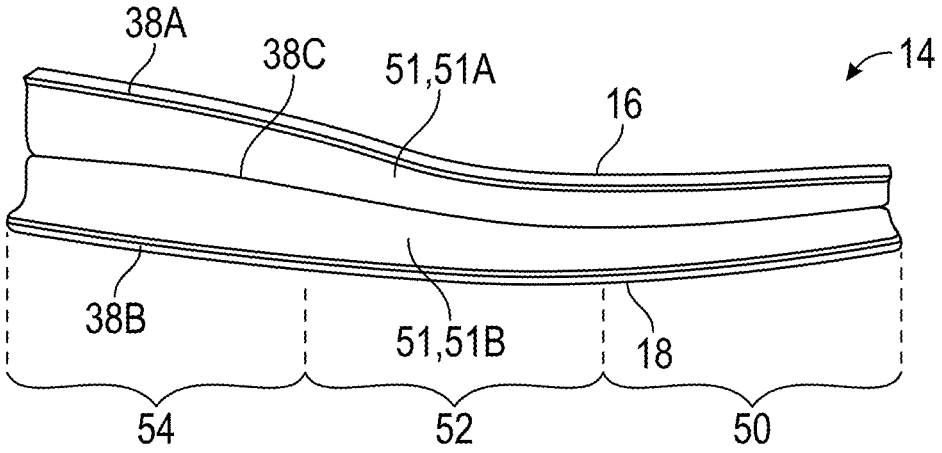
FIG. 9 is a lateral side view of the cushioning component of FIG. 4 in an inflated state.
Figure 10:
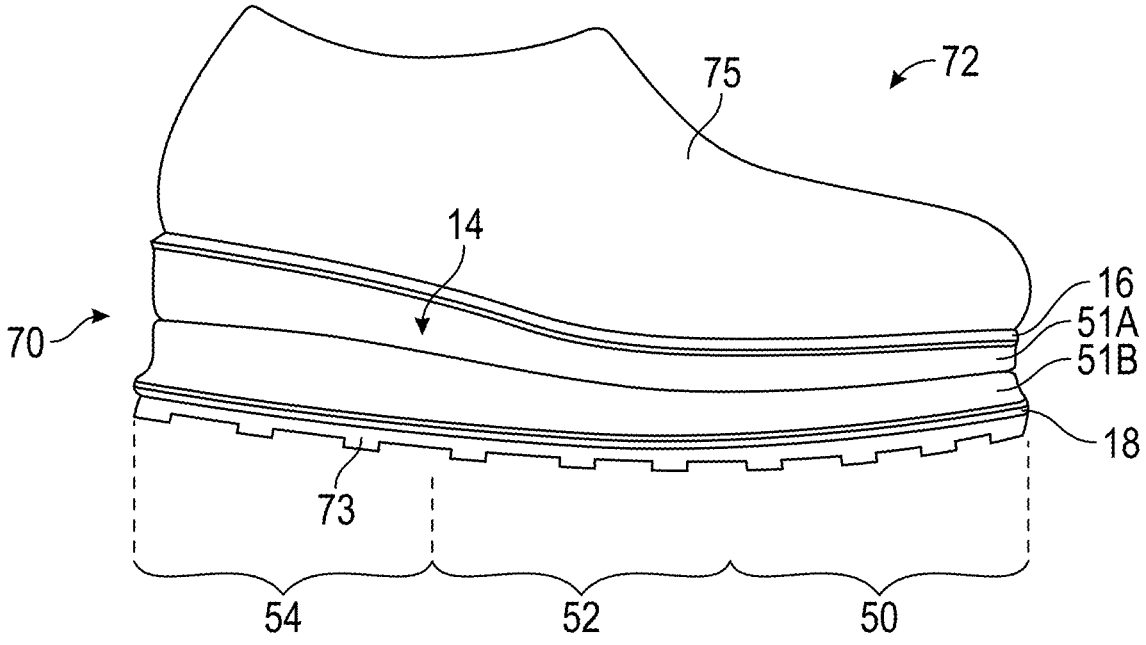
FIG. 10 is a lateral side view of an article of footwear with a sole structure including the cushioning component of FIG. 9.

As best shown in FIGS. 9-10, each of the core 12, the sidewall 51, the cushioning component 14, and the article of footwear 72 includes a forefoot region 50, a midfoot region 52, and a heel region 54. The forefoot region 50 generally includes portions of the article of footwear 72 or the core 12 corresponding with the toes and the joints connecting the metatarsals with the phalanges of a wearer's foot. The midfoot region 52 generally includes portions of the article of footwear 72 or the core 12 corresponding with the arch area of the foot, and the heel region 54 corresponds with rear portions of the foot, including the calcaneus bone. Each of the core 12, the sidewall 51, the cushioning component 14, the sole structure 70, and the article of footwear 72 include a medial side 80 and a lateral side 82 that extend through each of forefoot region 50, the midfoot region 52, and the heel region 54 and fall on opposite sides of a longitudinal midline (e.g., a longitudinal axis LA) of the cushioning component 14 indicated in FIG. 4. The forefoot region 50, the midfoot region 52, the heel region 54, the medial side 80, and the lateral side 82 are not intended to demarcate precise areas of the article of footwear 72, the core 12, the cushioning component 14, or the sole structure 70, but are instead intended to represent general areas of the article of footwear 72, the core 12, the cushioning component 14, and the sole structure 70 to aid in the following discussion.

FIG. 3 is a plan view of a first side 22 of the first polymeric sheet 10 with anti-weld material 24 disposed thereon. The opposite second side 26 does not have any anti-weld material 24 disposed thereon in the embodiment shown, but interfaces with anti-weld material on the first side 15 of the second polymeric sheet 11. The first polymeric sheet 10 is stacked on the second polymeric sheet 11 when the core 12 is assembled such that the second side 26 interfaces with and is bonded to the first side 15 of the second polymeric sheet 11 and the first side 22 interfaces with and is bonded to the inner surface 17 of the first barrier sheet 16 as shown in FIGS. 4-8 and discussed herein.

The anti-weld material 24 is disposed on the polymeric sheets 10, 11 of the core 12 at areas that will be unbonded areas when the core 12 is thermally processed. By utilizing anti-weld material 24 disposed on the polymeric sheets 10, 11, the patterns of bonds of the core 12 to the inner surfaces 17, 19 of the barrier sheets 16, 18, the bonds of the sidewall portions 51A, 51B to the inner surfaces 17, 19 and to one another, and the bonds of the second side 26 of the first polymeric sheet 10 to the first side 15 of the second polymeric sheet 11 are controlled to determine the final geometry of the completed cushioning component 14, including height differentials in different regions (e.g., forefoot region 50 and heel region 54) of the article of footwear 72, toe spring, etc.

As shown in FIGS. 5 and 6, portions of one or both of the inner surfaces 17, 19 that are outward of the outer perimeter 34 of the core 12 and inward of where peripheral bonds 38A and 38B with the sidewall portions 51A and 51B are formed are also preprinted with anti-weld material 24 or otherwise processed so that these portions of the inner surfaces 17, 19 will not bond to the sidewall portions 51A, 51B or to one another. Additionally, anti-weld material 24 is disposed between some of the interfacing surfaces of the sidewall portions 51A and 51B, except for the innermost interfacing portions where a peripheral bond 38C is formed. The peripheral bond 38A is referred to herein as a first peripheral bond. The peripheral bond 38B is referred to herein as a second peripheral bond. The peripheral bond 38C is referred to herein as a third peripheral bond.

The anti-weld material 24 may be disposed on the polymeric sheets 10 and 11 (and on the portions of the inner surfaces 17, 19 of the first barrier sheet 16 and/or second barrier sheet 18 shown in FIGS. 5-6) via a computer-controlled printer head or heads (not shown) according to a stored algorithm representing a predetermined printing pattern. As used herein, the anti-weld material 24 may be blocker ink, and may also be referred to as anti-weld ink. For example, when the anti-weld material is blocker ink, it may be printed according to a different predetermined programmed pattern for the first side 22 of the first polymeric sheet 10, the first side 15 of the second polymeric sheet 11 and the second side 13 of the second polymeric sheet 11 at all selected locations where bonds of the polymeric sheets 10, 11 of the core 12, to one another, to the sidewall 51, or to the barrier sheets 16, 18 are not desired.

Referring to FIGS. 1-3, the polymeric sheets 10, 11 are trimmed at outer perimeters 53A, 53B, respectively, and a slit 55A, 55B is cut through each polymeric sheet 10, 11, respectively. The slits 55A, 55B may be cut at the same time as the polymeric sheets 10, 11 are trimmed at the outer perimeters 53A, 53B, such as by using an automatic cutting machine. The slits 55A and 55B decouple the sidewall portions 51A and 51B from the respective core portions 12A and 12B. When bonded to one another such as by thermal processing, adjacent surfaces of the stacked, flat polymeric sheets 10, 11 and barrier sheets 16, 18 are bonded to one another except where the anti-weld material 24 is disposed. Accordingly, the patterns of anti-weld material 24 determine corresponding patterns of resulting bonds in the finished cushioning component 14.

The predetermined pattern of anti-weld material 24 on the second side 13 of the second polymeric sheet 11 in FIG. 1 is referred to as a second predetermined pattern and results in a second set of bonds 46 as well as the bond 38B discussed with respect to FIGS. 5-8. The predetermined pattern of anti-weld material 24 on the first side 15 of the second polymeric sheet 11 in FIG. 2 is referred to as a third predetermined pattern and results in a third set of bonds 47 as well as bond 38C discussed with respect to FIGS. 5-8. The predetermined pattern of anti-weld material 24 on the first side 22 of the first polymeric sheet 10 is referred to as a first predetermined pattern and results in a first set of bonds 44 as well as bond 38A discussed with respect to FIGS. 5-8.

With reference to FIG. 1, the anti-weld material 24 is disposed on the second side 13 of the second polymeric sheet 11 in the second predetermined pattern with areas A along a medial edge 23A of the core portion 12B (e.g., where the slit 55B is cut and which becomes part of the outer perimeter 34B of the core portion 12B), areas B along a lateral edge 23B of the core portion 12B (which is also where the slit 55B is cut and which becomes part of the outer perimeter 34B of the core portion 12B), areas C surrounded by the anti-weld material 24, and an uncovered area S1 free from anti-weld material. The area S1 borders the outer perimeter 53B and extends only partway across the sidewall portion 51B to the slit 55B as the remainder of the sidewall portion 51B on the second side 13 is covered with the anti-weld material 24. Areas A, B, C, and S1 are free from any deposited anti-weld material 24. An area 25 just above the deposited anti-weld material 24 in FIG. 1 is also free from anti-weld material 24, as is an area 27 just below the deposited anti-weld material 24. The areas A, B, and C will become a second set of bonds 46 indicated with dashed lines in FIG. 4, each corresponding with one of the areas. More specifically, areas A will become medial end bonds 46A, areas B will become lateral end bonds 46B, and areas C will become interior bonds 46C disposed between the medial end bonds 46A and the lateral end bonds 46B. Only some of the interior bonds 46C are labeled in FIG. 4. The bonds 46A, 46B, and 46C may be collectively referred to with reference number 46. The areas 25 and 27 will become a foremost bond and a rearmost bond of the core portion 12B to the second barrier sheet 18. The foremost bond and the rearmost bond are not included in the bonds 46 referred to herein as the second set of bonds. The area S1 will become the peripheral bond 38B of the sidewall portion 51B to the inner surface 19 of the second barrier sheet 18, as shown in FIGS. 5-8.

With reference to FIG. 2, the anti-weld material 24 is disposed on the first side 15 of the second polymeric sheet 11 in the third predetermined pattern. Areas E along the medial edge 23A of the core portion 12B, areas F along the lateral 23B of the core portion 12B, areas G surrounded by the anti-weld material 24, and an uncovered area S2 bordering the slit 55B on the sidewall portion 51B and free from any deposited anti-weld material 24. The area S2 extends only partway across the sidewall portion 51B toward the outer perimeter 53B. The remainder of the sidewall portion 51B on the first side 15 is covered with the anti-weld material 24. The areas E, F, G, and S2 are free from any anti-weld material. The areas E, F, and G will become a third set of bonds 47 shown in FIGS. 4-8, each corresponding with one of the areas. More specifically, areas E will become medial end bonds 47A, areas F will become lateral end bonds 47B, and areas G will become interior bonds 47C disposed between the medial end bonds 47A and the lateral end bonds 47B. The bonds 47A, 47B, and 47C may be collectively referred to with reference number 47. The area S2 will become the perimeter bond 38C of the sidewall portion 51B to the sidewall portion 51A, as shown in FIGS. 5-8.

With reference to FIG. 3, the anti-weld material 24 is disposed on the first side 22 of the first polymeric sheet 10 in the first predetermined pattern with areas H along a medial edge 37 of the core portion 12A (e.g., where the slit 55A is cut and which becomes part of the outer perimeter 34A of the core portion 12A), areas I along a lateral edge 39 of the core portion 12A (which is also where the slit 55A is cut and which becomes part of the outer perimeter 34A), areas J surrounded by the anti-weld material 24, and an uncovered area S3 bordering the outer perimeter 53A and extending only partway across the sidewall portion 51A toward the slit 55A. The remainder of the sidewall portion 51A on the first side 22 is covered with the anti-weld material 24. The areas H, I, J, and S3 are free from any deposited anti-weld material 24. An area 41 just above the deposited anti-weld material 24 in FIG. 3 is also free from anti-weld material 24, as is an area 43 just below the deposited anti-weld material 24. The areas H, I, and J will become a first set of bonds 44 shown in FIG. 5, each corresponding with one of the areas. More specifically, areas H will become medial end bonds 44A, areas I will become lateral end bonds 44B, and areas J will become interior bonds 44C disposed between the medial end bonds 44A and the lateral end bonds 44B. The bonds 44A, 44B, and 44C may be collectively referred to with reference number 44. The areas 41 and 43 will become a foremost bond 45 and a rearmost bond 49, respectively, of the core portion 12A to the first barrier sheet 16. The foremost bond and the rearmost bond are not included in the bonds 44 referred to herein as the first set of bonds. The area S3 will become the perimeter bond 38A of the sidewall portion 51A to the inner surface 17 of the first barrier sheet 16, as shown in FIGS. 5-8.

Figure 4:
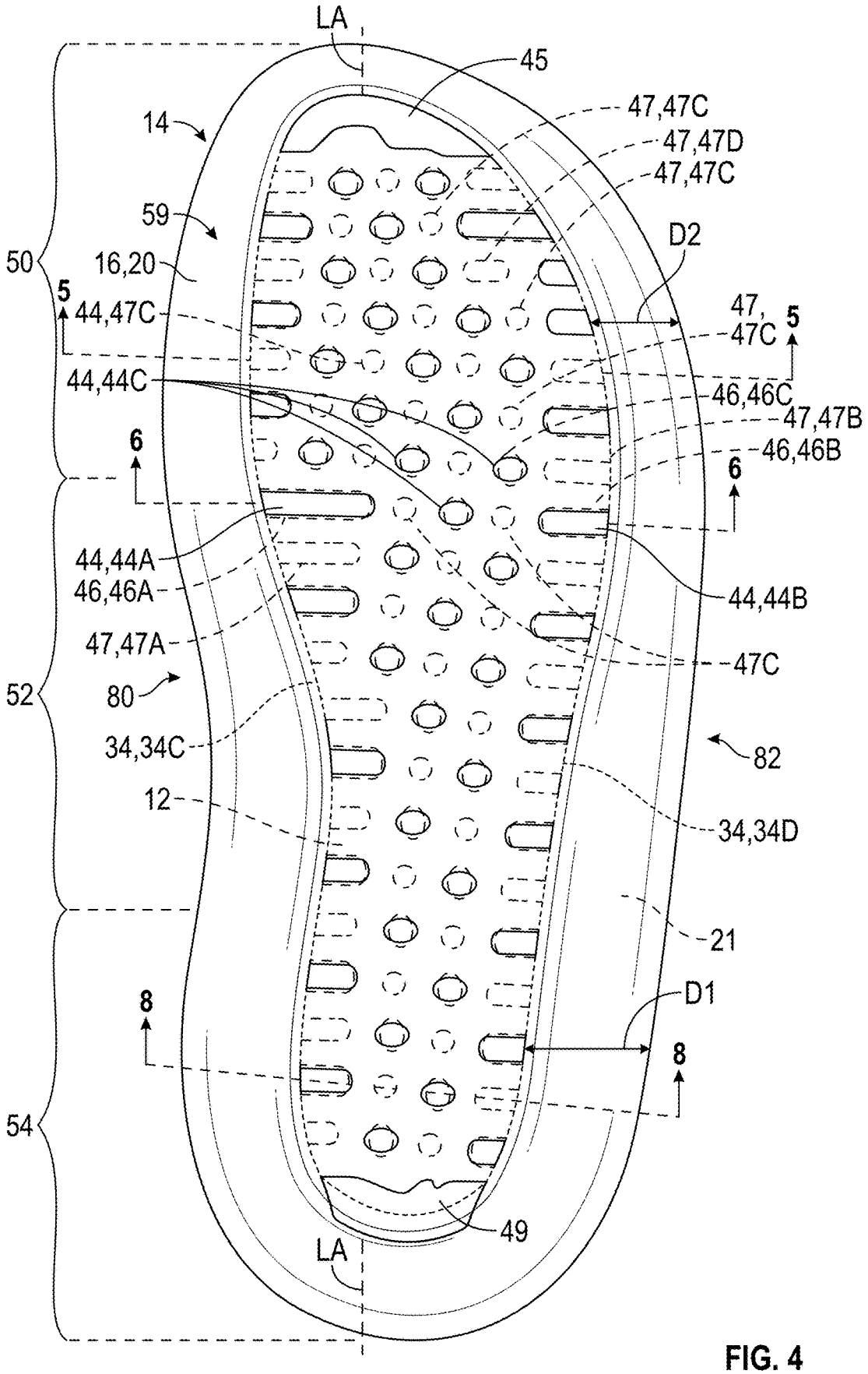
FIG. 4 is a plan view of a cushioning component in an inflated state, including a core and a sidewall formed from the polymeric sheets of FIGS. 1-3.

FIG. 4 illustrates the cushioning component 14 after trimming and cutting the core portions 12A and 12B and sidewall portions 51A and 51B, stacking these between the barrier sheets 16, 18 as shown in FIGS. 5 and 6, and thermally processing the barrier sheets 16, 18 to the core portions 12A and 12B and the sidewall portions 51A, 51B.

Figure 7:
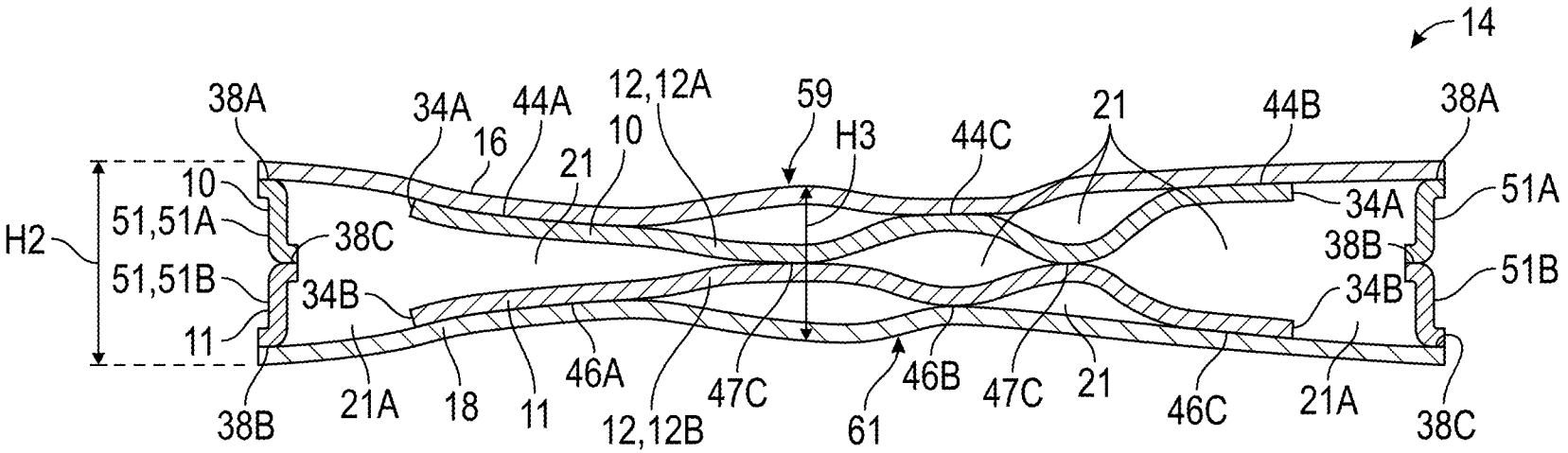
FIG. 7 is a cross-sectional view of the cushioning component of FIG. 6 in an inflated state.

As is apparent from FIGS. 1-4, anti-weld material 24 extends continuously from the medial edge 34C to the lateral edge 34D between adjacent rows and columns of bonds 44 (where rows are in the transverse direction and columns are in the fore-aft direction), between adjacent rows of bonds 46, and between rows of adjacent bonds 47. When the core portions 12A and 12B are stacked together, the outer perimeters 34A, 34B of the core portions 12A and 12B align, and may be referred to together as an outer perimeter 34 of the core 12. The medial edge 34C is a portion of the outer perimeter 34 of the core 12 at the medial side 80 of the longitudinal axis LA. The longitudinal axis LA is also referred to herein as a longitudinal midline. The lateral edge 34D is a portion of the outer perimeter 34 of the core 12 at the lateral side 82 of the longitudinal axis LA. By disposing the anti-weld material 24 so that it extends to an outer perimeter 34 of the core 12 at the inner surfaces 17, 19 of the barrier sheets 16, 18 and between the polymeric sheets 10, 11 (on the first side 15 of the second polymeric sheet 11), and by ensuring that the outer perimeter 34 of the core 12 is entirely inward of the peripheral bonds 38A and 38B of the barrier sheets 16, 18 to the sidewall 51 as shown in FIG. 7, for example, the resulting pattern of bonds 44, 46, and 47 of the multi-sheet core 12 does not result in any sealed chambers within the bladder 20 that are not in fluid communication with the interior cavity 21. In this way, the multi-sheet core 12 itself controls the final geometry of the inflated cushioning component 14 but does not affect the cushioning response of the cushioning component 14 under dynamic loading.

FIGS. 4-6 best illustrate the relative positioning of the sets of bonds 44, 46, and 47, and the peripheral bonds 38A, 38B, and 38C that is afforded by the precise predetermined patterns of the anti-weld material 24 disposed on the first side 22 of the first polymeric sheet 10, on the second side 13 of the second polymeric sheet 11, and on the first side 15 of the second polymeric sheet 11, respectively. In FIG. 4, the bonds 44 of the first set (44A, 44B, and 44C) are indicated with solid lines. The bonds 46 of the second set (46A, 46B, and 46C) are indicated with dashed lines. The bonds 47 of the third set (47A, 47B, and 47C) are indicated with a combination of dashed and dotted lines. Only some of the bonds are labeled in FIG. 4 for clarity in the drawings. It is clear from the FIG. 4 that the bonds 47 of the third set alternate with the bonds 44 of the first set along a length of the core 12 (e.g., along a length of the first polymeric sheet 10 of the core 12) and hence along a length of the resulting cushioning component 14. It is also clear from FIG. 4 that the bonds 47 of the third set alternate with the bonds 46 of the second set both transversely and along a length of the core 12 (e.g., along a length of the second polymeric sheet 11 of the core 12) and hence along a length of the resulting cushioning component 14. With this configuration, at least some of the bonds 46 of the second set are aligned with the at least some of the bonds 44 of the first set. More specifically, the bonds 44 of the first set are disposed vertically above the bonds 46 of the second set with a bond 47 of the third set offset from and vertically at a height between that of bond 44, 46 of each vertically-stacked set of bonds 44, 46 as indicated in FIGS. 5-8.

FIGS. 5 and 6 show that the uncovered portion of the second side 26 of the first polymeric sheet 10 at the sidewall portion 51A interfaces with the uncovered portion of the first side 15 of the second polymeric sheet 11 at the sidewall portion 51B and becomes the third peripheral bond 38C. The sidewall portions 51A and 51B of the polymeric sheets 10 and 11 are decoupled from the corresponding core portions 12A, and 12B of the polymeric sheets 10 and 11 at the slits 55A and 55B and, hence, when the cushioning component 14 is inflated as shown in FIGS. 7-10, the sidewall portions 51A and 51B separate from the core portions 12A and 12B. Stated differently, the third peripheral bond 38C extends outward from the outer perimeter 34A, 34B of the core 12 and is separated therefrom by a gap 21A indicated in FIG. 7. The gap 21A is the peripheral portion of the interior cavity 21. The sidewall portions 51A and 51B are bonded to one another at the third peripheral bond 38C along the sidewall 51. In other words, the third peripheral bond 38C falls between the sidewall portions 51A and 51B and so is considered to be along the sidewall 51. As shown in FIGS. 9 and 10, the third peripheral bond 38C extends around the perimeter of the cushioning component 14 and extends at each of the medial and lateral sides 80 and 82 in each of the forefoot region 50, the midfoot region 52, and the heel region 54.

FIGS. 5 and 6 show the cushioning component 14 in the uninflated state and the sidewall 51 in a first position in which the two sidewall portions 51A and 51B are stacked flat between the barrier sheets 16 and 18. Traditional tensile components may include a first polymeric sheet bonded only to the inner surface of the first barrier sheet, a second polymeric sheet bonded only to the inner surface of the second barrier sheet, and a plurality of tethers extending from the first polymeric sheet to the second polymeric sheet. Due to such a configuration, traditional tensile components are not relatively flat or sheet-like prior to inflating the interior cavity of a bladder in which they are disposed and are thus not amendable to heat pressing either to create a core of multiple polymeric sheets or to bond a core of a single polymeric sheet or multiple polymeric sheets to the inner surfaces of the barrier sheets.

Figure 8:
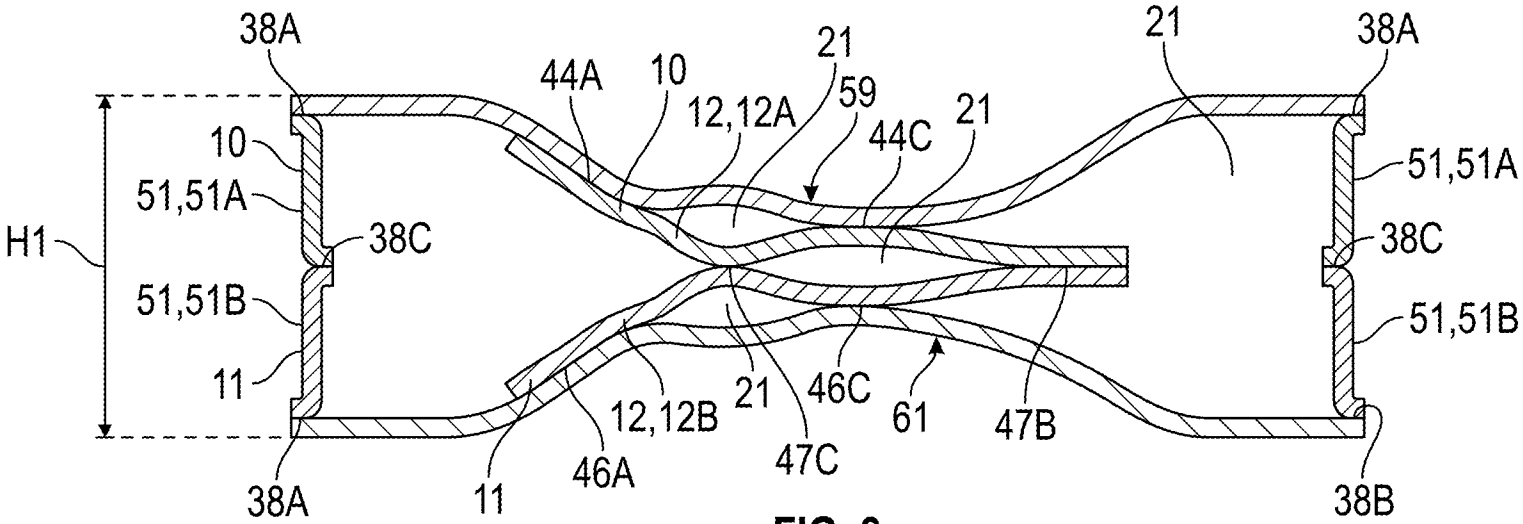
FIG. 8 is a cross-sectional view of the cushioning component of FIG. 4 taken at lines 8-8 in FIG. 4 in an inflated state.

FIGS. 7 and 8 show the cushioning component 14 in the inflated state, the interior cavity 21 filled with gas (e.g., air), and with the portion of the first polymeric sheet 10 that is the sidewall portion 51A and the portion of the second polymeric sheet 11 that is the sidewall portion 51B extending relatively vertically between the first barrier sheet 16 and the second barrier sheet 18. A small portion of the peripheral bond 38A or 38B may initially be left open to form a port and or to receive a fill tube to permit inflation of the interior cavity 21 with gas, such as air or nitrogen, and then may be sealed after inflation to completely enclose the interior cavity 21, retaining the gas in the interior cavity 21.

Because the peripheral bond 38C is formed between the sidewall portions 51A and 51B and the barrier sheets 16 and 18 are bonded to the respective sidewall portions 51A and 51B at the peripheral bonds 38A and 38B rather than to one another, the inflation pressure in the interior cavity 21 may cause the sidewall portions 51A and 51B to be almost vertical relative to the barrier sheets 16 and 18 rather than the cushioning component 14 having a more rounded perimeter. Moreover, because the sidewall portions 51A and 51B are wider in the heel region than in the forefoot region when in a flat state (as is evident in FIGS. 1-3), the vertical height of the sidewall 51 is greater in the heel region 54 (height H1 shown in FIG. 8) than in the forefoot region 50 (height H2 shown in FIG. 7) as is evident by comparing FIG. 7 to FIG. 8 and by reviewing FIGS. 9-10, for example.

FIGS. 7 and 8 show that the tension created in the bonded polymeric sheets 10, 11 of the core 12 by the inflation of the interior cavity 21 causes portions of the first barrier sheet 16 inward of the outer perimeter 34A or 34B of the core portions 12A and 12B to be pulled downward at the bonds 44, as indicated by the contoured outer surface 59 of the first barrier sheet 16. Because the outer perimeters 34A, 34B of the core portions 12A and 12B are entirely inward of the peripheral bonds 38A, 38B, and 38C, the barrier sheets 16, 18 will not be tethered together at the peripheral portion of the interior cavity 21 outward of the outer perimeters 34A and 34B. The distance between the inner surfaces 17 and 19 and the resulting height of the cushioning component 14 may thus be greatest outward of the core 12. As best shown in FIG. 7, for example, the core 12 tethers the first barrier sheet 16 to the second barrier sheet 18 such that a vertical height H3 of the bladder 20 at the core 12 is less than the vertical height H2 of the bladder at the sidewall 251 at that cross-section. This height differential creates a concavity at an outer surface 59 of the first barrier sheet 16 that serves as at least a portion of a footbed. Similarly, tension created in the bonded polymeric sheets 10, 11 of the core 12 by the inflation of the interior cavity 21 causes portions of the second barrier sheet 18 inward of the outer perimeters 34A and 34B of the core portions 12A and 12B to be pulled upward at the bonds 46, as indicated by the contoured outer surface 61 of the second barrier sheet 18 in FIGS. 7 and 8. Stated differently, the second barrier sheet 18 has an inward concavity toward the core 12 at its outer surface 61 that opposes the concavity at the outer surface 59 of the first barrier sheet 16 toward the core 12. The contoured surface 59 is useful as a footbed, including a heel cup, as it is most depressed toward the center of the barrier sheet 16.

Figure 11:
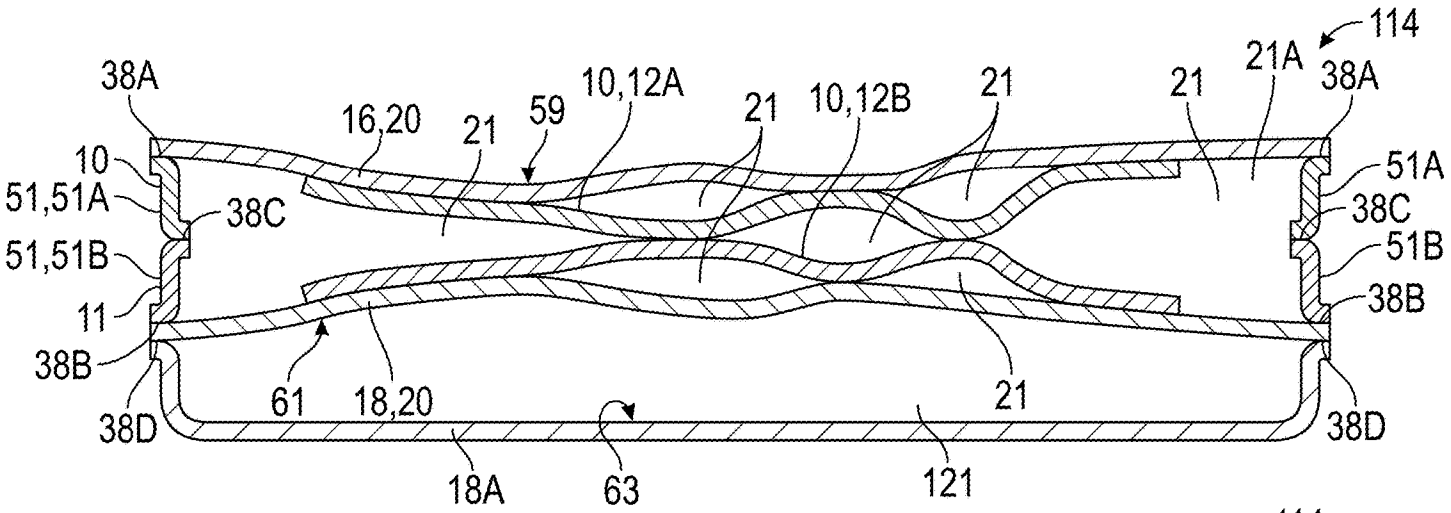
FIG. 11 is a cross-sectional view of an alternative embodiment of a cushioning component taken at lines 11-11 in FIG. 13 and in an inflated state.
Figure 12:
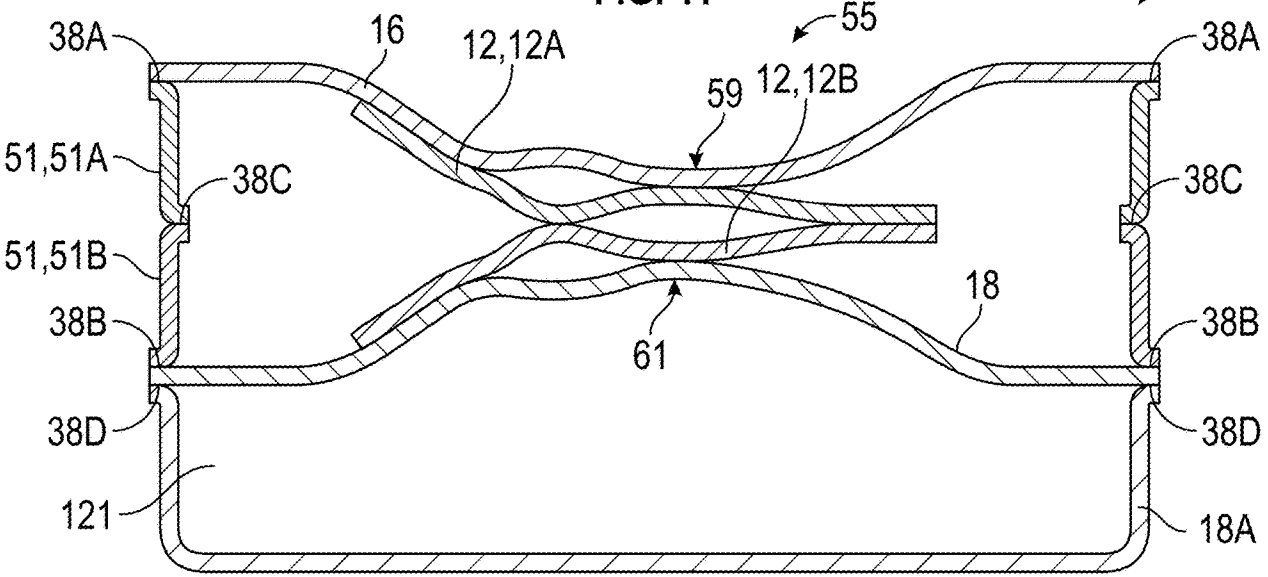
FIG. 12 is a cross-sectional view of the cushioning component of FIG. 13 taken at lines 12-12 in FIG. 13 and in an inflated state.
Figure 13:
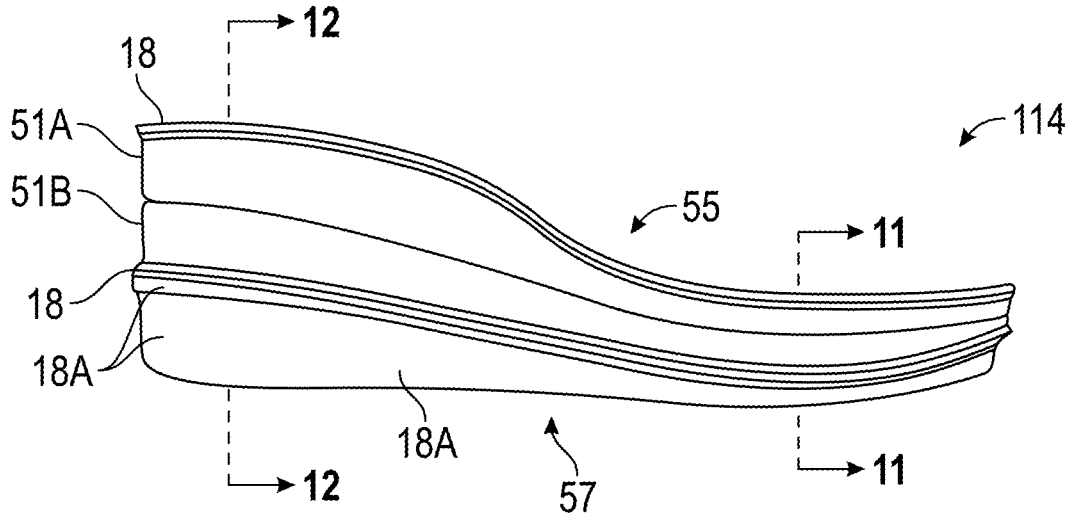
FIG. 13 is a lateral side view of the cushioning component of FIGS. 11 and 12 in an inflated state.

FIGS. 11-13 show another example of a cushioning component 114 that may be included in a sole structure of an article of footwear, such as in the article of footwear 72, in place of the sole structure 70 and cushioning component 14. In the embodiment shown in FIGS. 11-13, the contoured outer surface 59 at the first barrier sheet 16 is achieved while also achieving a flatter ground-facing surface of the cushioning component 114 by adding a third barrier sheet 18A. More specifically, the third barrier sheet 18A is bonded to the outer surface 61 of the second barrier sheet 18 at an additional peripheral bond 38D. In this configuration, the second barrier sheet 18 and the third barrier sheet 18A define a second interior cavity 121 between the outer surface 59 of the second barrier sheet 18 and an inner surface 63 of the third barrier sheet 18A. The internal cavity 21 (which may be referred to as a first internal cavity) is completed fluidly isolated from the second internal cavity 121 by the second barrier sheet 18.

Because the interior cavities 21 and 121 are fluidly isolated from one another, they may be inflated to and may retain gas at different inflation pressures than one another. For example, the inflation pressure in the interior cavity 121 may be greater than the inflation pressure in the internal cavity 21. As shown in FIG. 13, the first barrier sheet 18 is disposed at a foot-facing side 55 of the cushioning component 114 and the third barrier sheet 18A is disposed at a distal side 57 (e.g., closer to a ground contact surface during wear). Accordingly, providing a higher inflation pressure at the second interior cavity 121 may enable the third barrier sheet 18A to extend relatively flat relative to a concavity of the second barrier sheet 18 at the outer surface 61 where it is pulled inward by the core 12.

Figure 14:
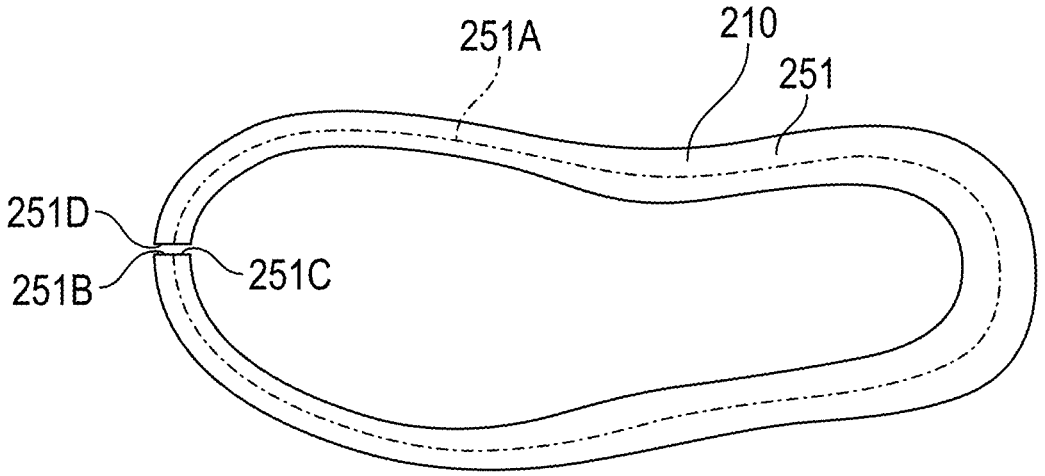
FIG. 14 is a plan view of a polymeric sheet for use as a sidewall of a cushioning component.
Figure 15:
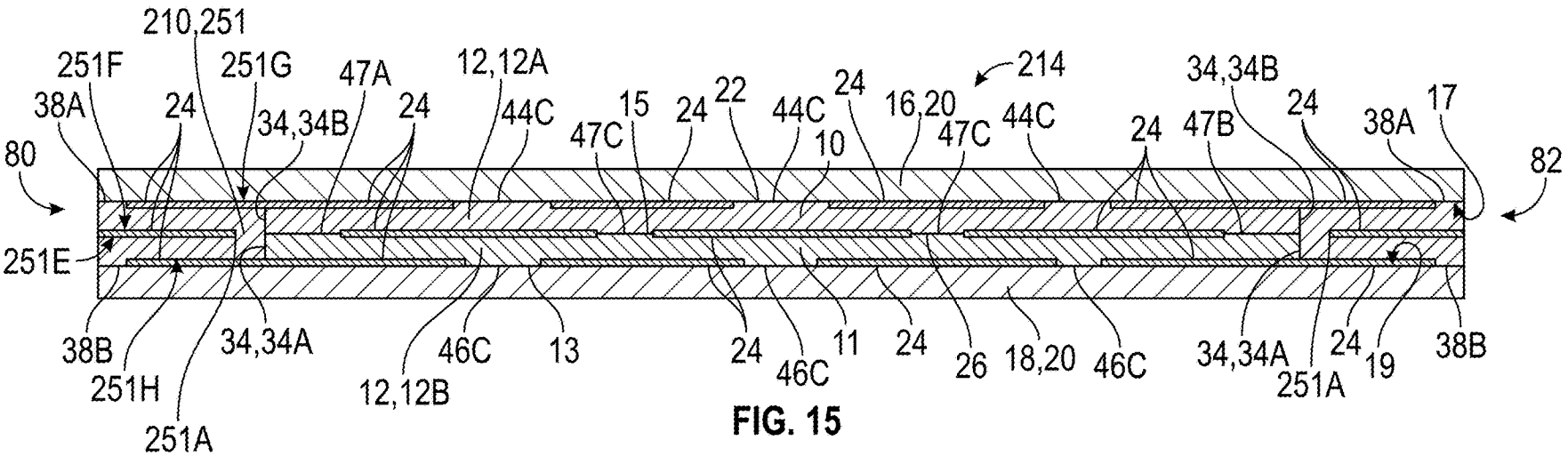
FIG. 15 is a cross-sectional view of an alternative embodiment of a cushioning component that includes the sidewall of FIG. 14, is taken at lines 15-15 in FIG. 19, and is in an uninflated state.
Figure 16:
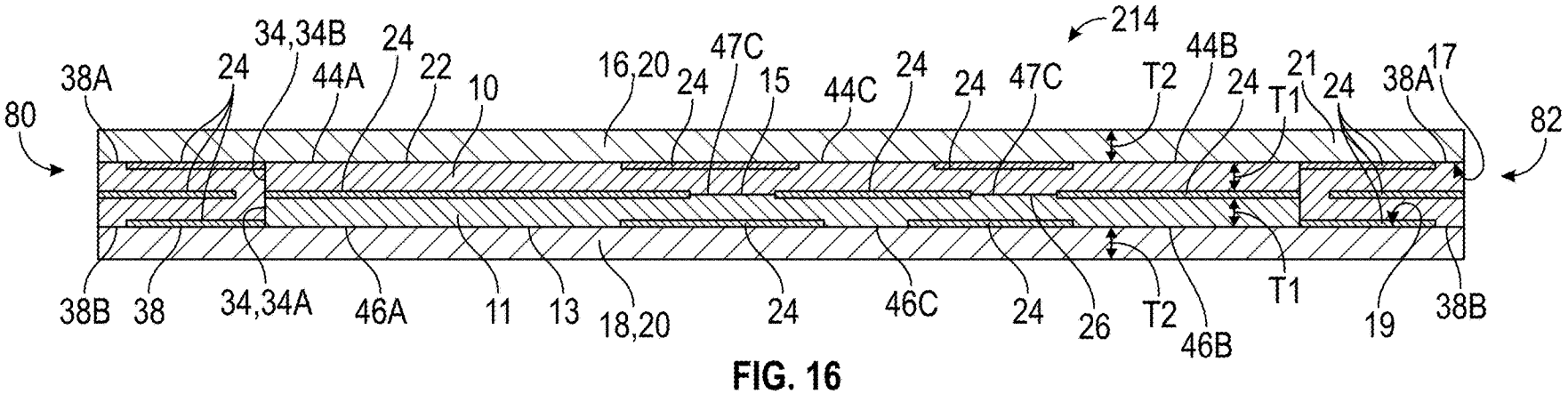
FIG. 16 is a cross-sectional view of the cushioning component of FIG. 19 taken at lines 16-16 in FIG. 19 and in an uninflated state.

FIG. 14 shows an example of a single polymeric sheet 210 trimmed in a shape enabling it for use as a sidewall 251 in a cushioning component 214 (shown in FIGS. 15-19) that may be included in a sole structure of an article of footwear, such as in the article of footwear 72 in place of the sole structure 70 and cushioning component 14. In an example, the sidewall 251 is a single polymeric sheet. The sidewall 251 could be cut from one of the polymeric sheets 10 or 11 as described with respect to the sidewall portions 51A and 51B or could be cut from a separate polymeric sheet. FIG. 14 shows a fold line 251A in phantom at which the sidewall 251 is folded when placed between the first and second barrier sheets 16 and 18 and outward of the outer perimeters 34A, 34B of the core portions 12A and 12B, as shown in FIGS. 15 and 16. In FIG. 14, the sidewall 251 is shown having a discontinuity via a cut 251B provided such that the sidewall 251 has ends 251C and 251D and is not a completely closed shape. This enables the polymeric sheets 210 to be more easily folded at the fold line 251A. In another example, the sidewall 251 may have no such cut and may be a closed shape.

The sidewall 251 has anti-weld material 24 deposited thereon at one or both of the surfaces 251E and 251F that face one another on the inner side of the folded sidewall 251 as shown in FIG. 15. The outer sides 251G and 251H of the folded sidewall 251 have anti-weld material 24 disposed thereon except near outer edges where the peripheral bonds 38A and 38B bond the sidewall 251 to the inner surface 17 of the first barrier sheet 16 and the inner surface 19 of the second barrier sheet 18, respectively. Alternatively, the anti-weld material 24 might instead or in addition be disposed on the inner surfaces 17 and 19 between the outer perimeter 34A, 34B of the core 12 and the peripheral bonds 38A and 38B. The ends 251C and 251D defined at the cut 251B might be overlapped upon one another without anti-weld material at their overlapping surfaces to create a seam in the sidewall 251, enabling the sidewall 251 along with the barrier sheets 16 and 18 encloses the interior cavity 21.

Figure 17:
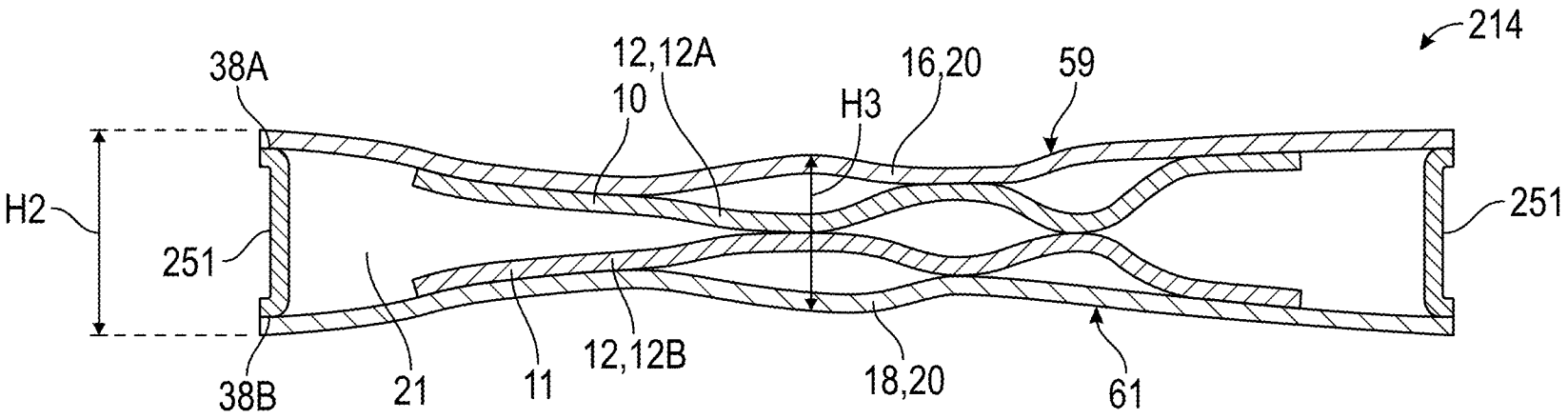
FIG. 17 is a cross-sectional view of the cushioning component of FIG. 16 in an inflated state.
Figure 18:
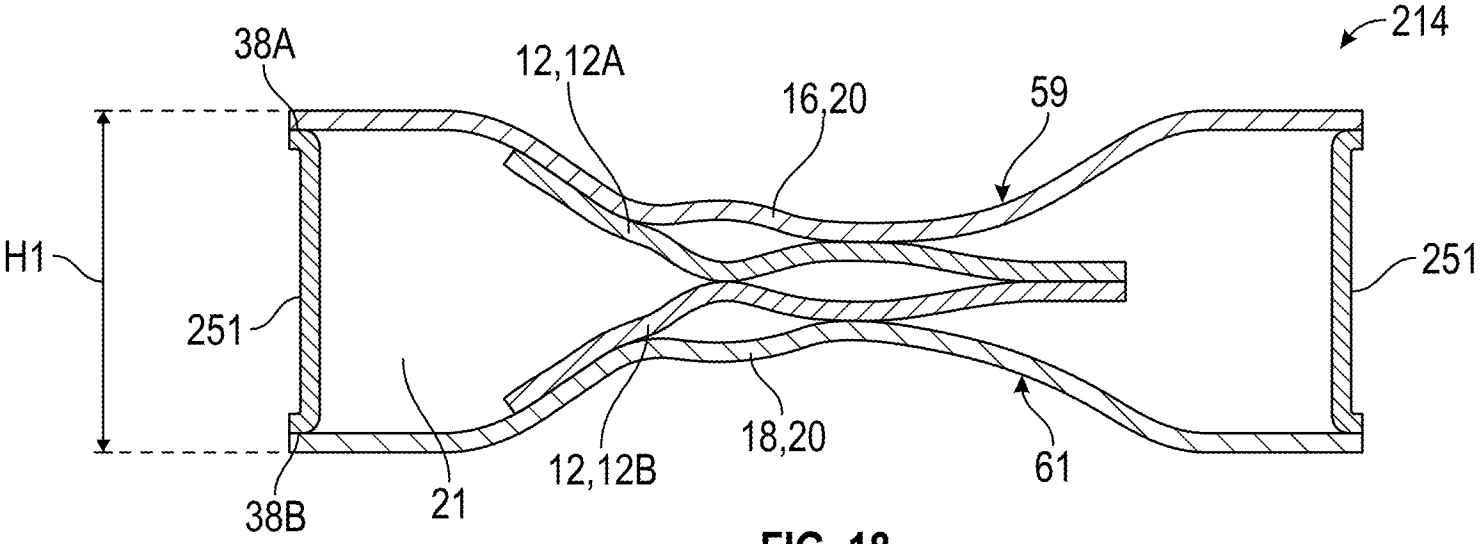
FIG. 18 is a cross-sectional view of the cushioning component of FIG. 19 taken at lines 18-18 in FIG. 19 and in an inflated state.
Figure 19:
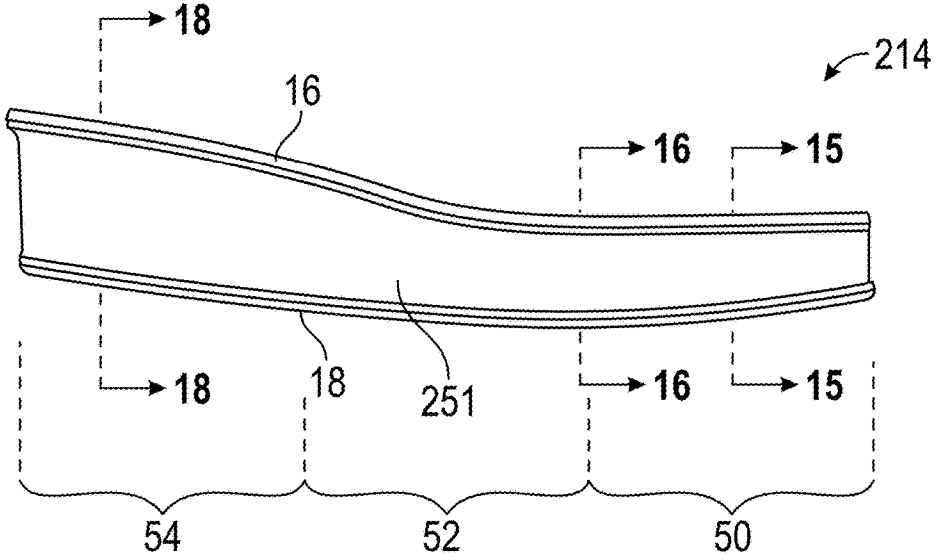
FIG. 19 is a lateral side view of the cushioning component of FIGS. 15-18 in an inflated state.

The sidewall 251 is in a first position when the interior cavity 21 is in an uninflated state, as shown in FIGS. 15 and 16 for example, and in a second position when the interior cavity 21 is in an inflated state, as shown in FIGS. 17-19. The sidewall 251 is relatively folded inward toward the core 12 in the first position and extends relatively vertically around the interior cavity 21 in the second position. In the second position, because the sidewall 251 is one-piece, and has only the peripheral bonds 38A and 38B (and no peripheral bond 38C), there is no middle seam extending around the sidewall 251 as there is at the peripheral bond 38C of the joined sidewall portions 51A and 51B of the cushioning components 14 and 114.

As shown in FIG. 19, the cushioning component 214 has a heel region 54, a midfoot region 52, and a forefoot region 50 and extends in each of these regions of the article of footwear 72 of FIG. 10 when included therein in a sole structure 70 in lieu of the cushioning component 14. Similar to the cushioning component 14, the sidewall 251 has a greater height in the heel region 54 than in the forefoot region 50, and is tethered by the core 12 such that the vertical height H3 at the core 12 is less than the vertical height H2 at the sidewall 251 (see FIG. 17), creating a concavity at both outer surfaces 59, 61 of the barrier sheets 16 and 18.

Figure 20:
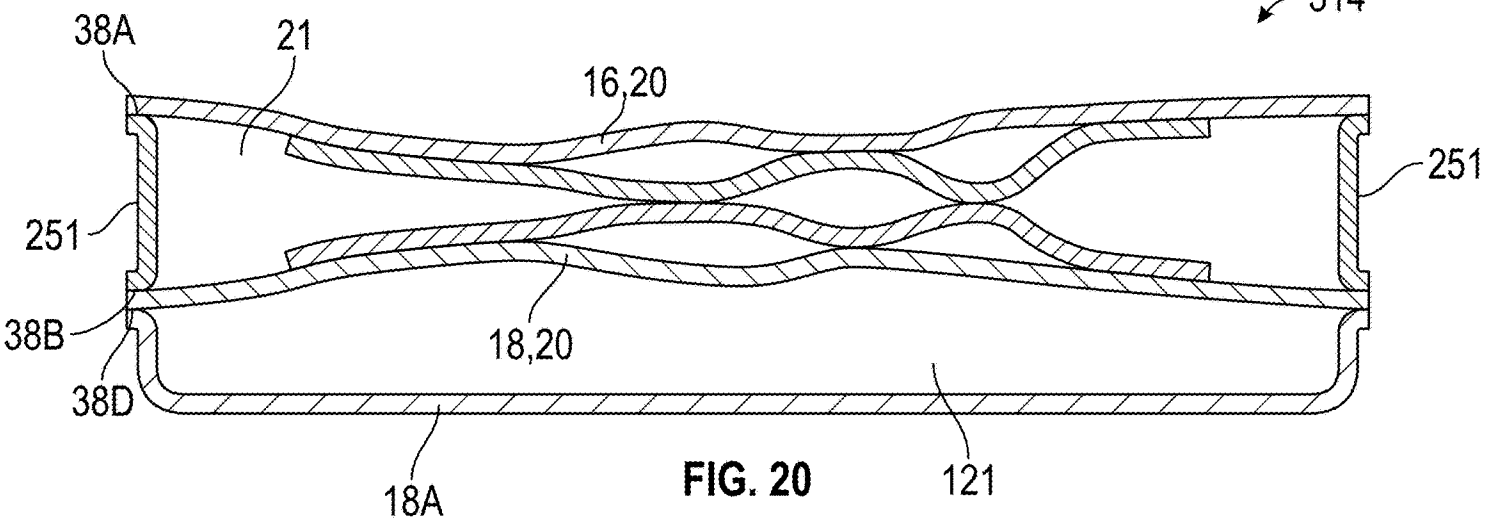
FIG. 20 is a cross-sectional view of an alternative embodiment of a cushioning component shown in FIG. 22, taken at lines 20-20 in FIG. 22 and in an inflated state.
Figure 21:
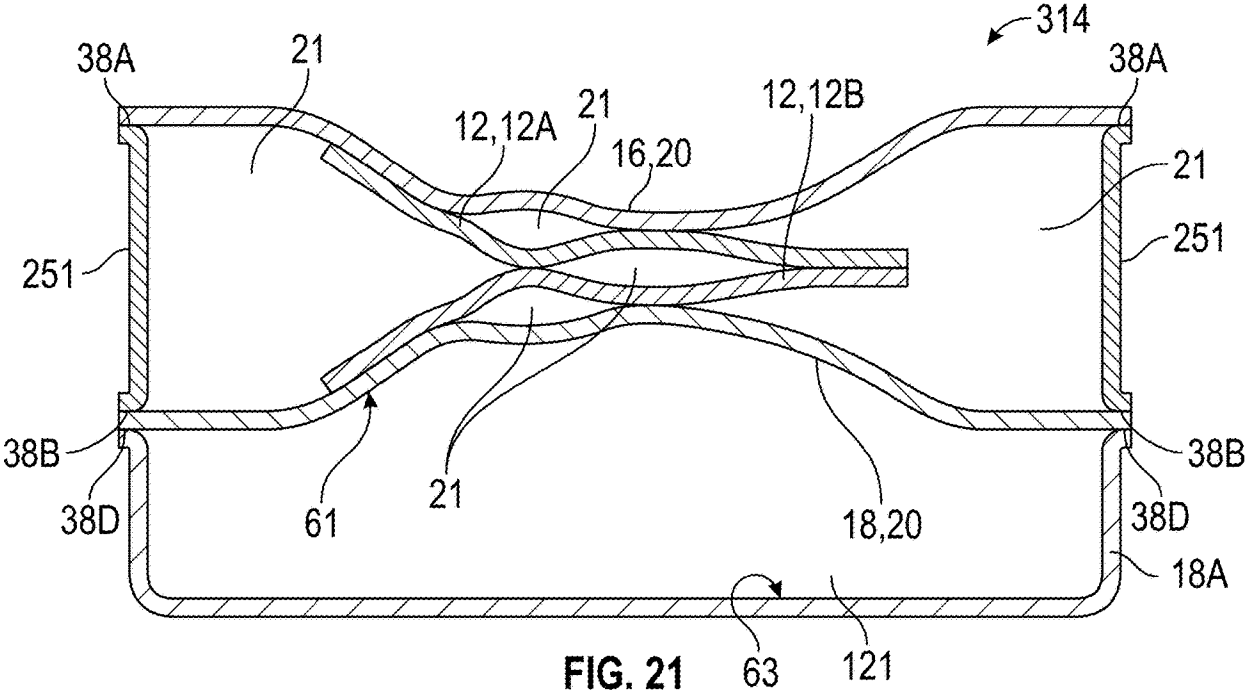
FIG. 21 is a cross-sectional view of the cushioning component of FIG. 22 taken at lines 21-21 in FIG. 22 and in an inflated state.
Figure 22:
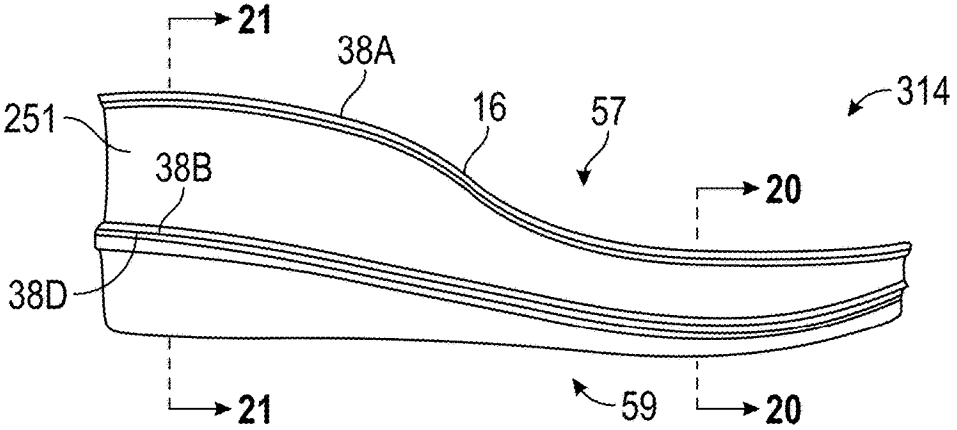
FIG. 22 is a lateral side view of the cushioning component of FIGS. 20-21 in an inflated state.

FIGS. 20-22 show a cushioning component 314 like cushioning component 214 but with a third barrier sheet 18A added and sealed to the outer surface 61 of the second barrier sheet 18 to create the fluidly isolated second interior cavity 121 with a different inflation pressure at the distal side 57 of the cushioning component 314, as described with respect to the cushioning component 114 of FIGS. 11-13.

Figure 23:
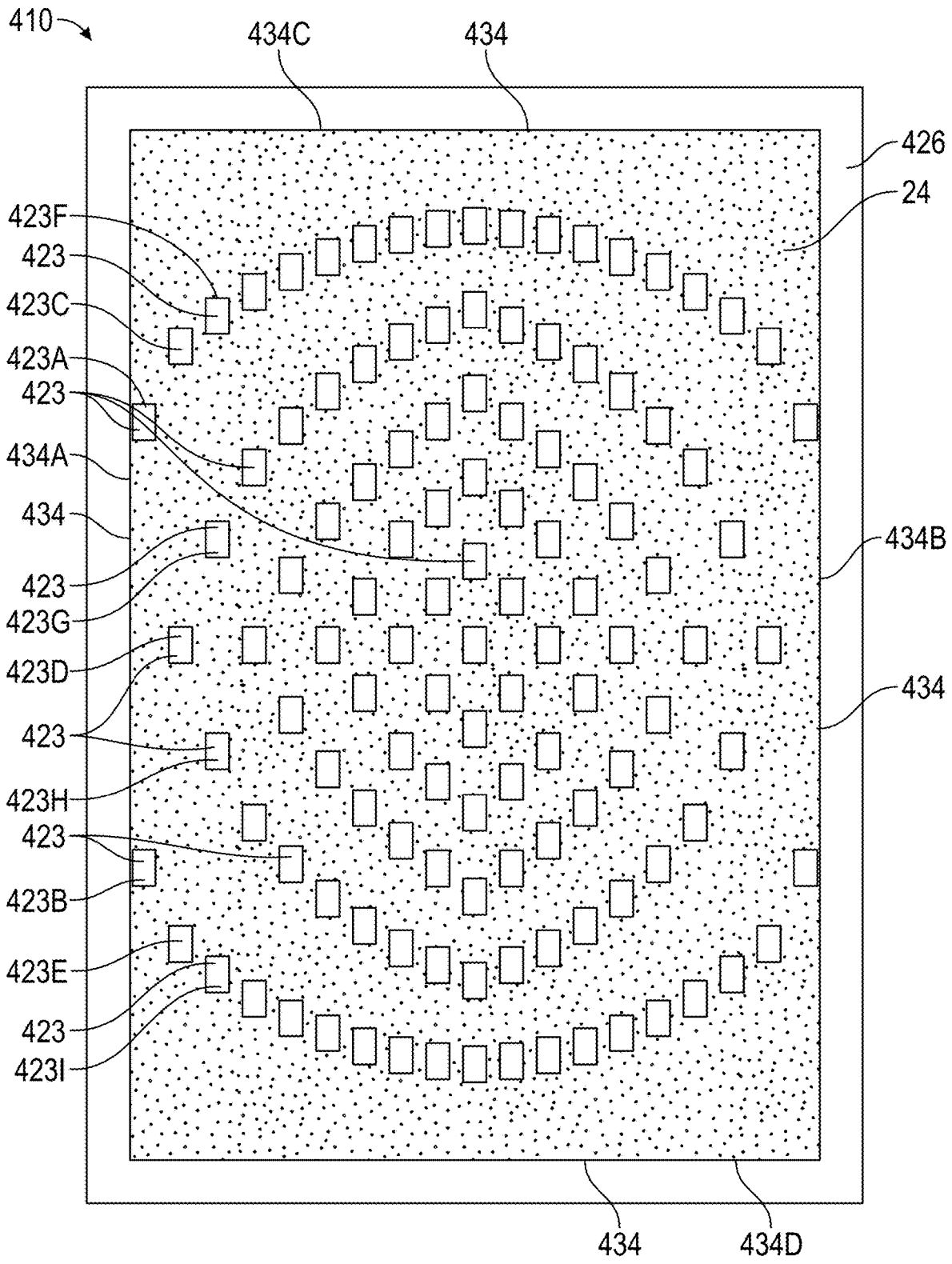
FIG. 23 is a plan view of a side of a polymeric sheet with anti-weld material disposed in a pattern thereon.
Figure 24:
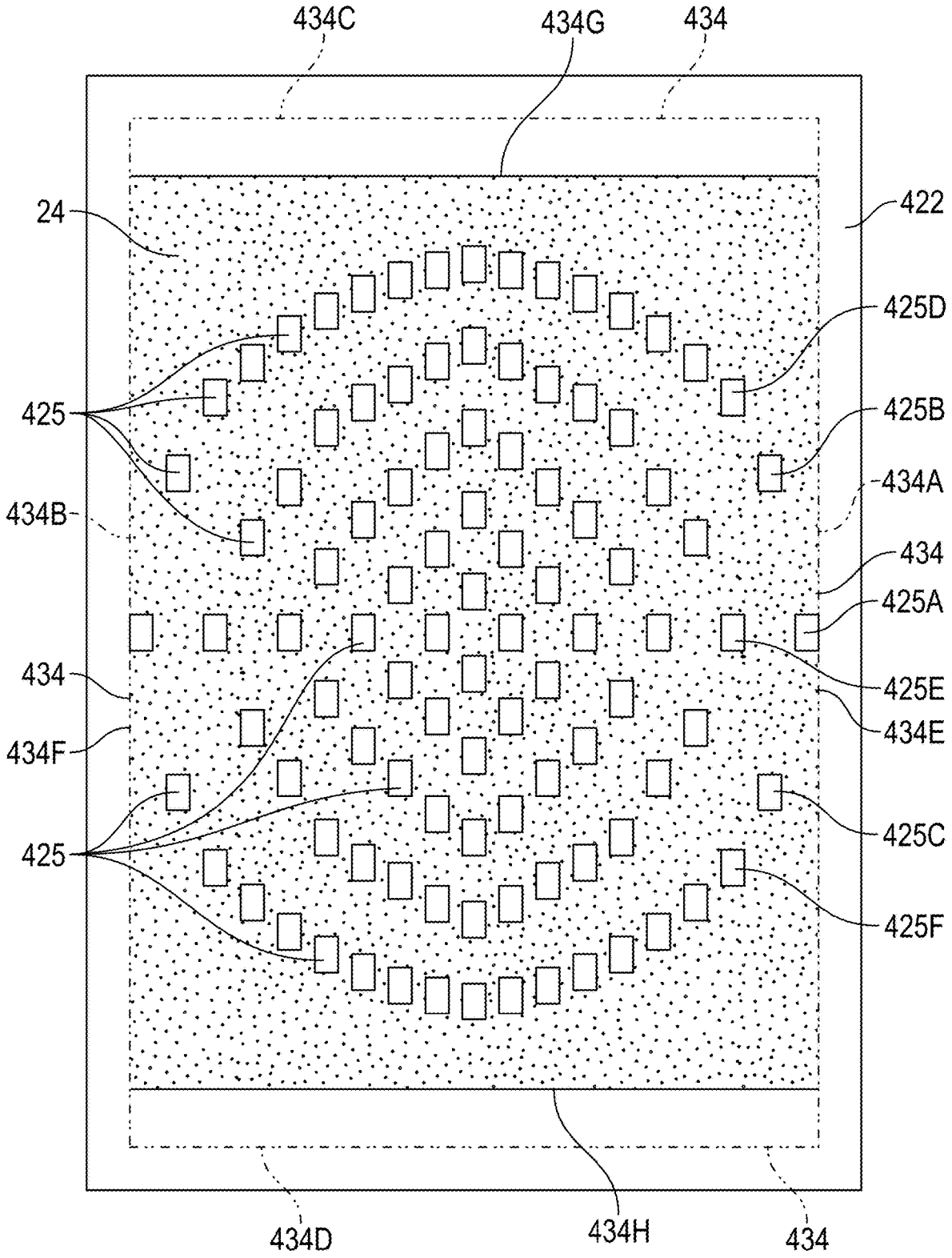
FIG. 24 is a plan view of an opposing side of the polymeric sheet of FIG. 23 with anti-weld material disposed thereon in a different pattern than on the side shown in FIG. 23.
Figure 25:
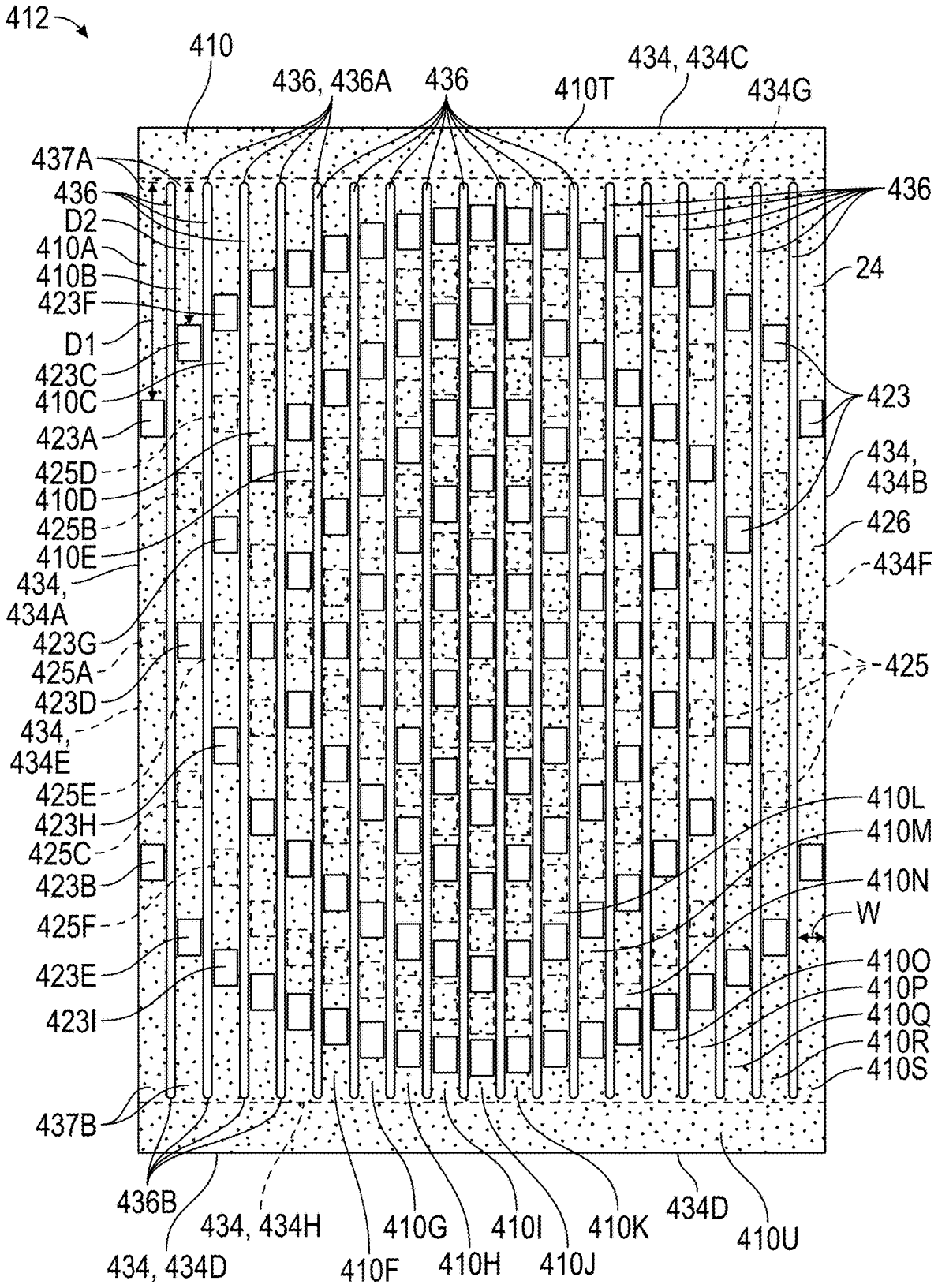
FIG. 25 is a plan view of the side of the polymeric sheet shown in FIG. 23 with spaced slots cut through the polymeric sheet to define strips bordering the slots, and indicating the areas on the opposing side that are not covered by anti-weld material in dashed lines.
Figure 26:
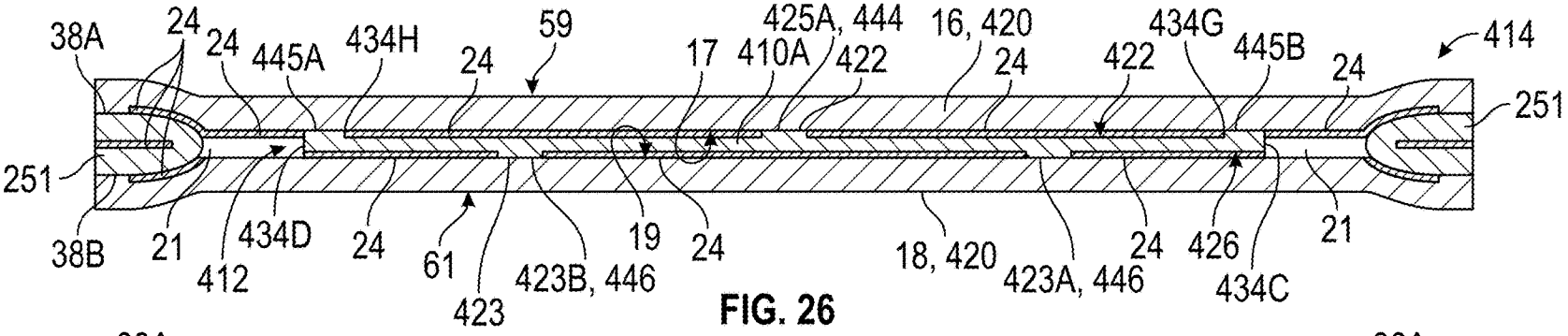
FIG. 26 is a cross-sectional view of a cushioning component in an uninflated state, including the polymeric sheet of FIG. 23 as a core, taken along an outer strip of the polymeric sheet, and with the core and a sidewall disposed between and bonded to opposing inner surfaces of first and second barrier sheets.
Figure 27:
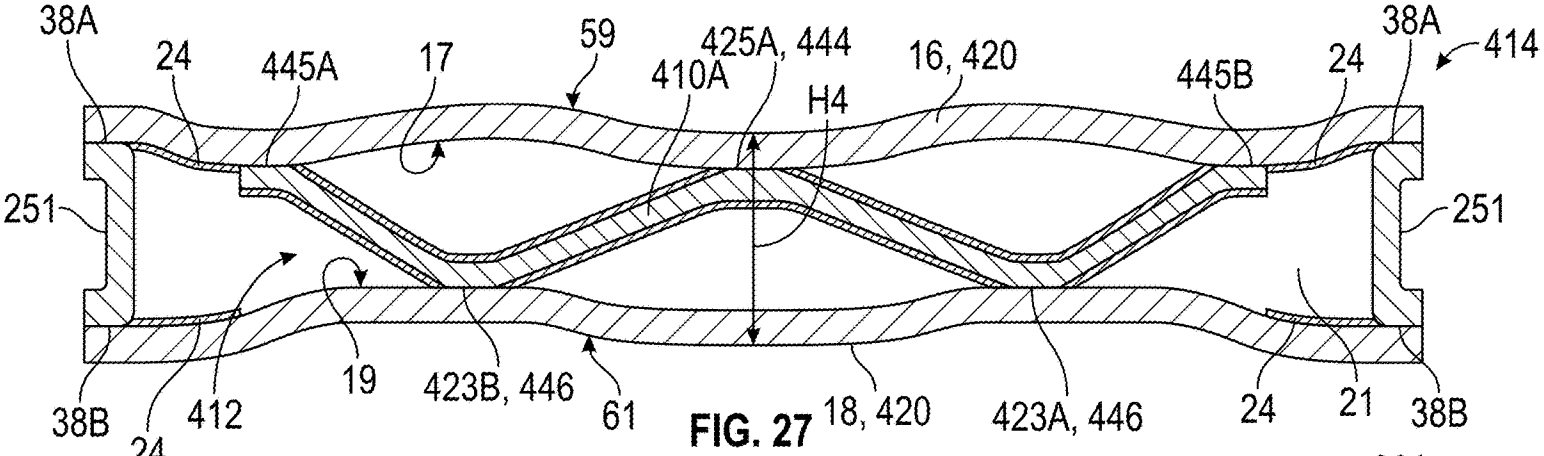
FIG. 27 is a cross-sectional view of the cushioning component of FIG. 26 in an inflated state.
Figure 28:
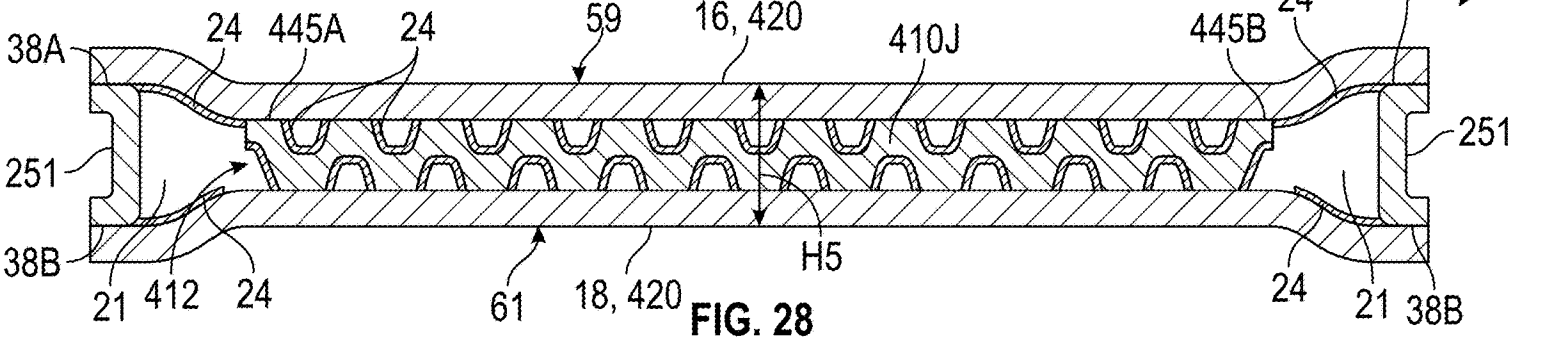
FIG. 28 is a cross-sectional view of the cushioning component of FIG. 26 in an inflated state taken at another location along a middle strip of the core.

FIGS. 23-24 show a single polymeric sheet 410 that is processed to become a single polymeric sheet core 412 shown in FIG. 25 and is bonded to the barrier sheets 16, 18 along with the sidewall 251 in the cushioning component 414 shown in FIGS. 26-28. The sidewall 251 is the same as described with respect to FIGS. 14-22, and is bonded to the first barrier sheet 16 at peripheral bond 38A and to the second barrier sheet 18 at peripheral bond 38B in FIGS. 26-28.

The core 412 is bonded to first and second barrier sheets 16, 18, that form a bladder 420 defining an interior cavity 21 between opposing inner surfaces of the first and second barrier sheets 16, 18 (e.g., between inner surface 17 of the first barrier sheet 16 and inner surface 19 of the second barrier sheet 18, as indicated in FIG. 27, for example). The polymeric sheet 410 is a single polymeric sheet and is the only polymeric sheet included in the core 412. The polymeric sheet 410 may be any of the materials described with respect to the polymeric sheet 10. Although the polymeric sheet 410 is a single polymeric sheet, in some examples, it may be comprised of multiple layers of materials, as discussed herein. Additionally, in some embodiments, a core may be used that includes multiple polymeric sheets.

FIG. 23 shows a side 426 of the polymeric sheet 410. The side 426 is referred to herein as a second side. Anti-weld material 24 is disposed on the second side 426 of the polymeric sheet 410 in a pattern that leaves a number of areas 423, and specifically 423A-423I) uncovered by the anti-weld material 24. The printed pattern of anti-weld material 24 in FIG. 23 is referred to herein as a second predetermined pattern. The anti-weld material 24 is indicated with shading and the uncovered areas 423 are shown without shading. Only some of the uncovered areas 423 are indicated with a reference number. The uncovered areas 423 are each of a generally rectangular shape and are of identical size (e.g., identical width and identical length). In other embodiments, the areas 423 left uncovered by the anti-weld material 24 may have different shapes and/or sizes.

As shown, the pattern of anti-weld material 24 has a first edge 434A, a second edge 434B, a third edge 434C, and a fourth edge 434D. The edges 434A and 434B are opposite from one another and the edges 434C and 434D are opposite from one another. The polymeric sheet 410 is trimmed along the edges 434A, 434B, 434C, and 434D before the core 412 is placed between the barrier sheets 16, 18. Accordingly, the edges 434A, 434B, 434C, and 434D become an outer perimeter 434 of the core 412.

FIG. 24 shows anti-weld material 24 disposed on an opposite side 422 (referred to herein as a first side 422) in a different predetermined pattern (referred to as a first predetermined pattern) than on the second side 426. Specifically, the first predetermined pattern shown in FIG. 24 leaves areas 425, and specifically areas 425A-425F, uncovered by the anti-weld material 24. Only some of the areas 425 are indicated with a reference number in FIG. 24. The areas 425 are each of a generally rectangular shape and are of identical size (e.g., identical width and identical length). In other embodiments, the areas 425 left uncovered by the anti-weld material 24 may have different shapes and/or sizes.

As shown, the first predetermined pattern of anti-weld material 24 has a first edge 434E that corresponds with and falls along the first edge 434A of the opposing side 426, a second side edge 434F that corresponds with and falls along the second edge 434B of the second side 426, a third edge 434G that is displaced from and closer to the center of the polymeric sheet 410 than the third edge 434C of the opposing second side 426, and a fourth edge 434H that is displaced from and closer to the center of the polymeric sheet 410 than the fourth edge 434D on the second side 426. The edges 434E and 434F are opposite from one another and the edges 434G and 434H are opposite from one another. The edges 434A, 434B, 434C, 434D, 434E, and 434F may also be referred to as side edges herein as they fall along the outer perimeter 434 of the core 412 after trimming the polymeric sheet 410, as shown in FIG. 25. The edge 434A may be referred to as a first side edge and the edge 434B may be referred to as a second side edge.

FIG. 25 shows the second side 426 of the polymeric sheet 410 after trimming the polymeric sheet to the outer perimeter 434 (e.g., to edges 434A, 434B, 434C and 434D at the anti-weld material 24) to define the core 412. In addition to trimming at the outer perimeter 434, a plurality of spaced slots 436 are cut through the polymeric sheet 410 (e.g., the slots 436 extend entirely through the polymeric sheet 410 from the first side 422 to the second side 426). In the example shown in FIG. 25, the slots 436 are linear and extend parallel to the opposing first and second side edges 434A, 434B of the core 412.

The slots 436 create a plurality of strips 410A, 410B, 410C, 410D, 410E, 410F, 410G, 410H, 410I, 410J, 410K, 410L, 410M, 410N, 410O, 410P, 410Q, 410R, and 410S. The strips 410A-410S border the slots 436 and are decoupled from one another at the slots 436. Stated differently, there is a slot 436 between each adjacent pair of strips. For example, there is a slot 436 between strips 410A and 410B, a slot 436 between strips 410B and 410C, a slot 436 between strips 410C and 410D, a slot 436 between strips 410D and 410E, a slot 436 between strips 410E and 410F, a slot 436 between strips 410F and 410G, a slot 436 between strips 410G and 410H, a slot 436 between strips 410H and 410I, a slot 436 between strips 410I and 410J, a slot 436 between strips 410J and 410K, a slot 436 between strips 410K and 410L, a slot 436 between strips 410L and 410M, a slot 436 between strips 410M and 410N, a slot 436 between strips 410N and 410O, a slot 436 between strips 410O and 410P, a slot 436 between strips 410P and 410Q, a slot 436 between strips 410Q and 410R, and a slot 436 between strips 410R and 410S. As shown, each of the slots 436 is of a constant width and each of the strips 410A-410S is of a constant width. In other words, each strip 410A-410S remains a constant width W (indicated in FIG. 25 with respect to the strip 410S) between an end of the strip adjacent to the first ends 436A of the slots 436 and an end of the strip adjacent the second ends 436B of the slots 436. In other examples, one or more of the slots 436 and/or one or more of the strips 410A-410S may vary in width.

Each of the slots 436 has a first end 436A and a second end 436B. Only some of the ends 436A, 436B are labelled in FIG. 25 for clarity in the drawing. The first end 436A and the second end 436B are inward of the outer perimeter 434. Stated differently, the first end 436A is closer to the center of the polymeric sheet 410 (which is half-way between the ends 436A, 436B) than is the edge 434C such that an end portion 410T of the polymeric sheet 410 remains between the first ends 436A and the edge 434C after cutting the slots 436. The second end 436B is closer to the center of the polymeric sheet 410 than is the edge 434D such that an end portion 410U remains between the second ends 436B and the edge 434D after cutting the slots 436. Because the first and second ends 436A, 436B are inward of the outer perimeter 434 (e.g., inward of edges 434C and 434D, respectively), after cutting the slots 436, the polymeric sheet 410 still remains a single piece (including all of the strips 410A-410S and the end portions 410T and 410U) for relatively easy handling during manufacturing in comparison to handling and aligning multiple polymeric sheets that would result if the ends 436A and 436B extended to the respective edges 434C and 434D. Stated differently, the strips 410A-410S are decoupled from one another at the slots 436, but all of the strips are 410A-410S joined to and integral with the end portions 410T and 410U. In other examples, the slots 436 could extend to the edge 434C and/or to the edge 434D. In the example shown, there are eighteen slots 436 and nineteen strips 410A-410S. In other examples, the number of slots 436 may be fewer or more than eighteen. In one example, there may be only one slot 436, creating only two strips.

FIG. 25 shows the uncovered areas 423 on the second side 426 in solid lines and indicates the uncovered areas 425 on the first side 422 with dashed lines. The uncovered areas 425 become a plurality of first bonds 444 (also referred to as a first set of bonds 444) of the first side 422 of the core 412 to the inner surface 17 of the first barrier sheet 16, some of which are indicated in FIGS. 26-28. The pattern of first bonds 444 is the same as the pattern of the uncovered areas 425. The uncovered areas 423 become a plurality of second bonds 446 (also referred to as a second set of bonds) of the second side 426 of the core 412 to the inner surface 19 of the second barrier sheet 18, some of which are shown in FIGS. 26-28. The pattern of second bonds 446 is the same as the pattern of the uncovered areas 423.

It is apparent from FIG. 25 that the uncovered areas 423 of the second predetermined pattern on the second side 426 are at least partially offset from the uncovered areas 425 of the first predetermined pattern on the first side 422. Again, only some of the uncovered areas 423 and 425 are indicated with reference numbers in FIG. 25. In the embodiment shown, the uncovered areas 423 are entirely offset from the uncovered areas 425. In fact, along a length of each strip 410A-410S, the uncovered areas 423 alternate with the uncovered areas 425. As a result, the bonds 444 of the first set (e.g., the bonds of the first side 422 of the core 412 to the inner surface 17 of the first barrier sheet 16) alternate with the bonds 446 of the second set (e.g., the bonds of the second side 426 of the core 412 to the inner surface 19 of the second barrier sheet 18) as can be seen with respect to the strips 10A and 10J indicated in FIGS. 27-28. This manner of alternating may allow the finest level of control of the geometry (e.g., the curvature) of the outer surfaces 59, 61 of the first and second barrier sheets 16, 18 shown in FIGS. 27-28. The outer surface 59 of the first barrier sheet 16 is on the opposite side of the barrier sheet 16 from the inner surface 17. The outer surface 61 of the second barrier sheet 18 is on the opposite side of the barrier sheet 18 from the inner surface 19.

It is also apparent from FIG. 25 that the uncovered areas 423 (and therefore the resulting second bonds 446) between the edge 434A and the middlemost strip 410J are symmetrical with the uncovered areas 423 (and therefore the resulting second bonds 446) between the edge 434B and the middlemost strip 410J. The same is true for the uncovered areas 425 and the resulting first bonds 444.

With reference again to FIG. 25, for purposes of discussion and comparison, the strip 410A may be referred to as a first strip and the strip 410B may be referred to as a second strip that is adjacent to the first strip 410A. The first strip 410A has two uncovered areas 423A and 423B spaced apart from one another along the length of the first strip 410A at the second side 426. The first strip 410A has only one uncovered area 425A along the length of the first strip 410A on the first side 422. The uncovered area 425A is disposed between the uncovered areas 423A and 423B but on the opposing second side 426. Accordingly, there will be one bond 444 of the first strip 410A to the first barrier sheet 16 and two bonds 446 of the first strip 410A to the second barrier sheet 18 with the bond 444 between the bonds 446, as shown in FIG. 26.

The second strip 410B has three uncovered areas 423C, 423D, and 423E spaced apart from one another along the length of the second strip 410B at the second side 426. The second strip has two uncovered areas 425B and 425C spaced apart from one another along the length of the second strip 410B on the opposing first side 422. The uncovered area 425B is disposed between the uncovered areas 423C and 423D along the length of the second strip 410B but on the opposing first side 422. The uncovered area 425C is disposed between the uncovered areas 423D and 423E along the length of the second strip 410B but on the opposing first side 422. The two resulting second bonds 446 of the first strip 410A to the inner surface 19 of the second barrier sheet 18 (e.g., at uncovered areas 423A and 423B) will thus alternate with the one resulting first bond 444 of the first strip 410A to the inner surface 17 of the first barrier sheet 16 (e.g., at uncovered area 425A). Similarly, the two resulting first bonds 444 of the second strip 410B to the inner surface 17 of the first barrier sheet 16 (e.g., at uncovered areas 425B and 425C) will thus alternate with the three resulting second bonds 446 of the second strip 410B to the inner surface 19 of the second barrier sheet 18 (e.g., at uncovered areas 423C, 423D, and 423E).

Each strip has a first end 437A and a second end 437B, only some of which are labelled in FIG. 25. The first end 437A is between the first ends 436A of the two adjacent slots 436 for strips 410B-410R, or for the strips 410A and 410Q at the side edges 434A and 434B, respectively, adjacent to the ends 436A and 436B of the one adjacent slot 436. The uncovered area 423A on the second side 426 of the first strip 410A nearest the first end 437A of the first strip 410A is a distance D1 from the first end 437A of the first strip 410A. In comparison, the uncovered area 423C on the second side 426 of the second strip 410B that is nearest to the first end 437A of the second strip 410B is a distance D2 from the first end 437A. The distance D2 is less than the distance D1.

Similarly, a distance from the uncovered area 425A on the first side 422 of the first strip 410A to the first end 437A of the first strip 410A is greater than a distance from the uncovered area 425B on the first side 422 of the second strip 410B to the first end 437A of the second strip 410B. In fact, for strips between the edge 434A and the middlemost strip 410J (e.g., strips 410A-410I), the distance from the first end 437A of each strip 410A-410I to the nearest uncovered area 423 on the second side 426 of the strip and to the nearest uncovered area 425 on the first side 422 of that strip is greater the closer the strip is to the edge 434A and the further the strip is from the middlemost strip 410J. Similarly, for strips between the edge 434B and the middlemost strip 410J (e.g., strips 410K-410S), the distance from the first end 437A of each strip 410K-410S to the nearest uncovered area 423 on the second side 426 of that strip and to the nearest uncovered area 425 on the first side 422 of that strip is greater the closer the strip is to the edge 434B and the further the strip is from the middlemost strip 410J.

The same is true with respect to the relative distances of the uncovered areas 423 and 425 from the second ends 437B. That is, for strips between the edge 434A and the middlemost strip 410J (e.g., strips 410A-410I), the distance from the second end 437B of each strip 410A-410I to the nearest uncovered area 423 on the second side 426 of that strip and to the nearest uncovered area 425 on the first side 422 of that strip is greater the closer the strip is to the edge 434A and the further the strip is from the middlemost strip 410J. Similarly, for strips between the edge 434B and the middlemost strip 410J (e.g., strips 410K-410S), the distance from the second end 437B of each strip 410K-410S to the nearest uncovered area 423 on the second side 426 and to the nearest uncovered area 425 on the first side 422 of that strip is greater the closer the strip is to the edge 434B and the further the strip is from the middlemost strip 410J. This placement of the uncovered areas 423 and 425 relative to the first and second ends 437A and 437B creates an arced arrangement of the uncovered areas 425 and 423 and the resulting bonds 444 and 446, respectively, closest to the ends 437A and 437B, as is evident in FIG. 25.

The geometry of the outer surfaces 59 and 61 of the respective barrier sheets 16 and 18 will be affected by this placement of uncovered areas 423 and 425 as the barrier sheets 16 and 18 will be tethered closer to one another by the core 412 gradually in a direction from the edge 434A toward the middlemost strip 410J and in a direction from the edge 434B toward the middlemost strip 410J. Additionally, the barrier sheets 16, 18 will be held closer to one another by the bonds 444 and 446 near the middle of the core 412 between the edges 434C and 434D (e.g., at a row of uncovered areas including uncovered area 425A and uncovered area 423D in FIG. 25).

A desired geometry at the outer surface 59 and 61 is also affected by utilizing different spacing between adjacent uncovered areas 423 or 425 and resulting bonds 444 or 446 on different ones of the strips 410A-410S. For purposes of discussion and comparison of this example, the strip 410B will now be referred to as a first strip and the strip 410C will be referred to as a second strip. The strip 410B has two uncovered areas 425B and 425C on the first side 422 and three uncovered areas 423C, 423D, and 423E on the second side 426. The strip 410C has three uncovered areas 425D, 425E, and 425F on the first side 422 and four uncovered areas 423F, 423G, 423H, and 423I on the second side 426. The uncovered areas 425B and 425C are spaced slightly further from one another than the uncovered areas 425D and 425E are from one another, and slightly further than one another than the uncovered areas 425E and 425F are from one another. Similarly, the uncovered areas 423C and 423D on the second side 426 of the strip 410B are spaced further than one another than the uncovered areas 423F and 423G are from one another on the second side 426 of the strip 410C. The uncovered areas 423D and 423E have the same spacing as uncovered areas 423C and 423D, which is further than the spacing between uncovered areas 423F and 423G, and the spacing between uncovered areas 423G and 423H, and uncovered areas 423H and 423I. The strip 410B is closer to the outer perimeter 434 (at edge 434A) of the core 412 than the strip 410C, and the uncovered areas 423, 425 on the respective sides 426, 422 of the strip 410B are further apart from one another than uncovered areas 423, 425 on the respective sides 426, 422 of the strip 410C. Specifically, as shown in FIG. 25, the number of uncovered areas 423 (and resulting second bonds 446) and the number of uncovered areas 425 (and resulting first bonds 444 on each strip) increases in order in a direction away from each of the side edges 434A, 434B such that the strips closer to the side edges 434A or 434B have a greater number of the resulting bonds 444 and 446 than the strips further from the side edges (e.g., strips closer to the middlemost strip 410J have a greater number of bonds 444 and 446 than strips further from the middlemost strip 410J). The first and second barrier sheets 16, 18 are thus held closer to one another by the core 412 at the strip 410C than at the strip 410B, for example, creating a depression at the outer surfaces 59 and 61 of the bladder 420 from the strip 410B to the second strip 410C (and, more expansively, from the side edges 434A and 434B to the middlemost strip 410J.

FIG. 26 illustrates cushioning component 414 taken at a cross-section through the first strip 410A when the core 412 is placed between the first and second barrier sheets 16, 18. When bonded to one another such as by thermal processing, bonds are created between adjacent surfaces of the stacked, flat polymeric sheet 410 of the core 412 and barrier sheets 16, 18 except where the anti-weld material 24 is disposed. This placement of the patterns of the anti-weld material 24 relative to the outer perimeter 434 as well as placing the core 412 so that the entire outer perimeter 434 is entirely inward of the sidewall 251 ensures that the core 412 will tether the first and second barrier sheets 16 and 18 without creating any sealed chambers that are not in fluid communication with the interior cavity 21. FIG. 26 shows the edges 434D and 434C of the core 12 inward of the peripheral bonds 38A and 38B of the sidewall 251 to the respective barrier sheets 16 and 18. The core 412 will thus collapse to return toward the flat state under dynamic compressive loading of the cushioning component 414 and acts as a tether to control and vary the distance between the respective inner surfaces 17, 19 of the barrier sheets 16, 18 without affecting the ability of the bladder 420 to compress under loading.

The core 412 is inverted in FIG. 26 relative to its position in FIG. 25 so that the first side 422 is facing upward, and the edge 434D is shown at the left. The uncovered area shown in FIG. 24 between the edge 434D and the edge 434H on the first side 422 becomes a bond 445A shown in FIG. 26. The uncovered area shown in FIG. 24 between the edge 434C and the edge 434G on the first side 422 becomes a bond 445B shown in FIG. 26.

As can be seen in FIG. 26, the first predetermined pattern of the anti-weld material 24 on the first side 422 of the polymeric sheet 410 (at strip 410A) is disposed against the inner surface 17 of the first barrier sheet 16, and the second predetermined pattern of the anti-weld material 24 on the second side 426 of the polymeric sheet 410 is disposed against the inner surface 19 of the second barrier sheet 18. Portions of one or both of the inner surfaces 17, 19 that are outward of the outer perimeter 434 of the core 412 and inward of where the peripheral bonds 38A and 38B are formed may also be preprinted with anti-weld material 24 or otherwise processed so that these portions of the inner surfaces 17, 19 will not bond to one another or to the sidewall 251.

A first pattern of bonds 444 is formed at the interfacing areas of the first side 422 of the polymeric sheet 410 and the inner surface 17 of the first barrier sheet 16 (e.g., at all of the uncovered areas 425 where there is not anti-weld material 24 between the first side 422 and the inner surface 17). A second pattern of bonds 446 is formed at the interfacing areas of the second side 426 of the polymeric sheet 410 and the inner surface 19 of the second barrier sheet 18 (e.g., at all of the uncovered areas 423 where there is not anti-weld material 24 between the second side 426 and the inner surface 19). The anti-weld material 24 prevents bonding at any interfacing areas where it is disposed. As can be seen in FIG. 26, the core 412 lays flat within the bladder 420 with the unbonded areas (areas at anti-weld material 24) contacting the opposing inner surfaces 17, 19 when the interior cavity 21 of the bladder 420 is uninflated.

FIG. 27 is a cross-sectional view of the cushioning component 414 of FIG. 26 in an inflated state. Inflating the interior cavity 21 causes the polymeric sheet 410 (shown at strip 410A) to be tensioned between the barrier sheets 16, 18 and move from the relatively flat state of FIG. 26 to the relatively extended state of FIG. 27.

By placing the unbonded areas, and hence the resulting bonds at different distances from the ends of the respective strips, different numbers along each strip, and at different spacings along each strip, a desired geometry of the outer surface of the bladder 420 near the ends of the core 412 can be achieved. For example, the resulting cushioning component 414 formed by the core 412 and the barrier sheets 16, 18 of the bladder 420 will thus have a gradual depression in a direction from the edge 434C toward the middlemost row at bonds 444, 446 at uncovered areas 425A, 423D, for example, in a direction from the edge 434D toward the middlemost row. The cushioning component 414 will also have a gradual depression in a direction from the edge 434A toward the middlemost strip 410J and from the edge 434B toward the middlemost strip 410J. Stated differently, the resulting cushioning component 414 will have a concavity in both a direction along a length of the cushioning component 414 and along a width of the cushioning component 414 and on both the foot-facing and the distal sides (e.g., at both outer surfaces 59, 61). Either surface 59 or 61 could thus serve as a heel cup, for example, conforming to the convex outer surface of a wearer's heel. When oriented with the outer surface 59 at the foot-facing side, the outer surface 59 serves as a heel cup.

FIG. 28 shows the cushioning component 414 taken at a cross-section along the middlemost strip 410J. It is apparent in a comparison of FIGS. 27 and 28 that the overall height H4 of the cushioning component 414 at the strip 410A is greater than the overall height H5 of the cushioning component 414 at the middlemost strip 410J. The greater number of bonds 444 and 446 (only some of which are labelled) along the strip 410J tethers the barrier sheets 16 and 18 closer to one another than do the fewer number of bonds along the strip 410A. Tension of the strip 410A due to the inflation of the interior cavity 21 causes the outer surfaces 59 and 61 to be pulled inward at the bonds 444 and 446, resulting in a relatively wavy or otherwise contoured outer surface 59 and 61 outward of the strip 410A. In contrast, the greater number of bonds 444, 446 that are closer together to one another along the strip 410J results in relatively flat outer surfaces 59 and 61 outward of strip 410J. The pattern of anti-weld material 24 printed on the polymeric sheet 410 and the resulting patterns of bonds 444, 446 of the polymeric sheet 410 of the core 412 to the barrier sheets 16, 18 can thus be selected to control the resulting contours of the outer surfaces 59, 61 of the barrier sheets 16, 18.

A method of manufacturing a cushioning component for a wearable article, such as cushioning component 14, 114, 214, 314, and 414 disclosed herein, may include disposing blocker ink 24 on opposing first and second sides of at least one polymeric sheet (e.g., polymeric sheets 10 and 11, or polymeric sheet 410), and placing the at least one polymeric sheet between a first barrier sheet 16 and a second barrier sheet 18. The at least one polymeric sheet may include a core 12 or 412, and a sidewall (e.g., sidewall 51 or 251) surrounding an outer perimeter 34 or 434 of the core and decoupled from the core. The method may also include thermally bonding the core to opposing inner surfaces 17 and 19 of the first barrier sheet 16 and the second barrier sheet 18 at a plurality of bonds 44 and 46, or 444 and 446, at areas (e.g., uncovered areas 425 and 423, respectively) of the at least one polymeric sheet at which the blocker ink is not disposed to tether the first barrier sheet to the second barrier sheet, and also thermally bonding the sidewall 51 or 251 to the first barrier sheet 16 at a first peripheral bond 38A and to the second barrier sheet 18 at a second peripheral bond 38B, the sidewall and the barrier sheets enclosing an interior cavity 21 that extends between the opposing inner surfaces to define a bladder 20 or 420.

In an example, such as with respect to the cushioning component 14, the method may include, prior to the thermal bonding step, cutting a slot through the at least one polymeric sheet (e.g., slits 55A and 55B through the polymeric sheets 10 and 11) to decouple the core 12 from the sidewall 51 (including sidewall portions 51A and 51B). An outer perimeters 34A and 34B of the core 12 may be defined by the slits 55A and 55B and may be inward of the slits 55A and 55B, and the sidewall 51 may be outward of the slot.

In another example, such as with respect to any of the cushioning components 214, 314, and 414, placing the at least one polymeric sheet (such as polymeric sheets 10 and 11 or polymeric sheet 410) between the first barrier sheet 16 and the second barrier sheet 18 may include folding the sidewall 251 with a fold (e.g., at fold line 251A shown in FIGS. 14 and 15) extending inward toward the outer perimeter 34 or 434 of the core 12 or 412.

In an implementation in which the wearable article is an article of footwear, such as the article of footwear 72, the method may also include disposing the cushioning component 14, 114, 214, 314, or 414, in a sole structure of the article of footwear.

The following Clauses provide example configurations of a cushioning component for a wearable article, such as an article of footwear, and a method of manufacturing the cushioning component, as disclosed herein.

Clause 1. A cushioning component for a wearable article, the cushioning component comprising: a bladder including a first barrier sheet and a second barrier sheet defining an interior cavity between opposing inner surfaces of the first barrier sheet and the second barrier sheet; a core including at least one polymeric sheet traversing the interior cavity between and directly bonded to the opposing inner surfaces of the first barrier sheet and the second barrier sheet at a plurality of bonds to tether the first barrier sheet to the second barrier sheet; and a sidewall comprising at least one polymeric sheet disposed around an outer perimeter of the core and directly bonded to the first barrier sheet at a first peripheral bond and to the second barrier sheet at a second peripheral bond to enclose the interior cavity and retain a gas in the interior cavity, the at least one polymeric sheet of the core disposed in the interior cavity and decoupled from the sidewall, and the at least one polymeric sheet of the core displaced from the opposing inner surfaces by gas at unbonded areas of the at least one polymeric sheet.

Clause 2. The wearable article of clause 1, wherein the plurality of bonds are arranged such that the gas in the interior cavity is in fluid communication around the at least one polymeric sheet of the core without the at least one polymeric sheet of the core creating any sealed chambers within the bladder that are not in fluid communication with the interior cavity.

Clause 3. The wearable article of any of clauses 1-2, wherein the sidewall is a single polymeric sheet.

Clause 4. The wearable article of clause 3, wherein: the sidewall is in a first position when the interior cavity is in an uninflated state and in a second position when the interior cavity is in an inflated state; and the sidewall is relatively folded inward toward the core in the first position and extends relatively vertically around the interior cavity in the second position.

Clause 5. The cushioning component of any of clauses 1-2, wherein: the wearable article is an article of footwear; and the cushioning component is included in a sole structure of the article of footwear.

Clause 6. The cushioning component of clause 5, wherein: the cushioning component extends in each of a heel region of the article of footwear, a midfoot region of the article of footwear, and a forefoot region of the article of footwear; and the sidewall has a greater height in the heel region than in the forefoot region.

Clause 7. The cushioning component of clause 5, wherein the interior cavity is a first interior cavity, and the cushioning component further comprising: a third barrier sheet bonded to the second barrier sheet at an additional peripheral bond, the second barrier sheet and the third barrier sheet defining a second interior cavity between an outer surface of the second barrier sheet and an inner surface of the third barrier sheet; and wherein the first interior cavity and the second interior cavity are fluidly isolated from one another by the second barrier sheet.

Clause 8. The cushioning component of clause 7, wherein: the third barrier sheet is disposed at a distal side of the cushioning component and the first barrier sheet is disposed at a foot-facing side of the cushioning component; and an inflation pressure of the second interior cavity is different than an inflation pressure of the first interior cavity.

Clause 9. The cushioning component of clause 7, wherein: the third barrier sheet is disposed at a distal side of the cushioning component and the first barrier sheet is disposed at a foot-facing side of the cushioning component; the core tethers the first barrier sheet to the second barrier sheet such that a vertical height of the bladder at the core is less than a vertical height of the bladder at the sidewall; a concavity at an outer surface of the first barrier sheet defines at least a portion of a footbed; and the third barrier sheet is relatively flat in comparison to the second barrier sheet.

Clause 10. The cushioning component of any of clauses 1-2, wherein: the at least one polymeric sheet of the core includes a first polymeric sheet and a second polymeric sheet, the first polymeric sheet of the core disposed between the first barrier sheet and the second polymeric sheet, and the second polymeric sheet of the core disposed between the first polymeric sheet and the second barrier sheet such that a first side of the first polymeric sheet of the core faces the inner surface of the first barrier sheet, a second side of the first polymeric sheet of the core faces a first side of the second polymeric sheet, and a second side of the second polymeric sheet of the core faces the inner surface of the second barrier sheet; and the at least one polymeric sheet of the sidewall includes a first polymeric sheet and a second polymeric sheet, the first polymeric sheet of the sidewall bonded to the first barrier sheet at the first peripheral bond, the second polymeric sheet of the sidewall bonded to the second barrier sheet at the second peripheral bond, and the first polymeric sheet of the sidewall bonded to the second polymeric sheet of the sidewall at a third peripheral bond disposed along the sidewall between the first peripheral bond and the second peripheral bond.

Clause 11. The cushioning component of clause 10, wherein: the first side of the first polymeric sheet of the core is directly bonded to the inner surface of the first barrier sheet at a first set of bonds of the plurality of bonds, the second side of the second polymeric sheet of the core is directly bonded to the inner surface of the second barrier sheet at a second set of bonds of the plurality of bonds, and the second side of the first polymeric sheet of the core is directly bonded to the first side of the second polymeric sheet of the core at a third set of bonds of the plurality of bonds.

Clause 12. The cushioning component of clause 10, wherein: the sidewall is in a first position when the interior cavity is in an uninflated state and in a second position when the when the interior cavity is in an inflated state; in the second position, the first polymeric sheet of the sidewall and the second polymeric sheet of the sidewall extend relatively vertically between the first barrier sheet and the second barrier sheet in comparison to the first position with the third peripheral bond extending outward of the outer perimeter of the core and separated therefrom by a gap.

Clause 13. A cushioning component for a wearable article, the cushioning component comprising: a bladder including a first barrier sheet and a second barrier sheet defining an interior cavity between opposing inner surfaces of the first barrier sheet and the second barrier sheet; a first polymeric sheet and a second polymeric sheet disposed between the first barrier sheet and the second barrier sheet and each including a core portion and a sidewall portion decoupled from the core portion and extending along an outer perimeter of the core portion; wherein the core portion of the first polymeric sheet is bonded to the inner surface of the first barrier sheet and to a first side of the core portion of the second polymeric sheet at a first plurality of bonds, the core portion of the second polymeric sheet is bonded to the inner surface of the second barrier sheet at a second plurality of bonds and to a second side of the core portion of the first polymeric sheet at a third plurality of bonds, the core portion of the first polymeric sheet and the core portion of the second polymeric sheet together traversing the interior cavity and tethering the first barrier sheet to the second barrier sheet; and wherein the sidewall portion of the first polymeric sheet is bonded to the first barrier sheet at a first peripheral bond, the sidewall portion of the second polymeric sheet is bonded to the second barrier sheet at a second peripheral bond, and the sidewall portion of the first polymeric sheet and the sidewall portion of the second polymeric sheet are bonded to one another at a third peripheral bond such that the sidewall portions and the first and second barrier sheets together enclose the interior cavity and retain a gas in the interior cavity, the first polymeric sheet of the core portion and the second polymeric sheet of the core portion displaced from the opposing inner surfaces of the first barrier sheet and the second barrier sheet by the gas at unbonded areas of the core portion of the first polymeric sheet and the core portion of the second polymeric sheet.

Clause 14. The cushioning component of clause 13, wherein the first plurality of bonds, the second plurality of bonds, and the third plurality of bonds are arranged such that the gas in the interior cavity is in fluid communication around the core portion of the first polymeric sheet and the core portion of the second polymeric sheet without the core portion of the first polymeric sheet and the core portion of the second polymeric sheet creating any sealed chambers within the bladder that are not in fluid communication with the interior cavity.

Clause 15. The cushioning component of any of clauses 13-14, wherein: the wearable article is an article of footwear; and the cushioning component is included in a sole structure of the article of footwear.

Clause 16. The cushioning component of clause 15, wherein: the cushioning component extends in each of a heel region of the article of footwear, a midfoot region of the article of footwear, and a forefoot region of the article of footwear; and the sidewall portion has a greater height in the heel region than in the forefoot region.

Clause 17. The cushioning component of clause 15, wherein the interior cavity is a first interior cavity, and the cushioning component further comprising: a third barrier sheet bonded to the second barrier sheet at an additional peripheral bond, the second barrier sheet and the third barrier sheet defining a second interior cavity between an outer surface of the second barrier sheet and an inner surface of the third barrier sheet; and wherein the first interior cavity and the second interior cavity are fluidly isolated from one another by the second barrier sheet.

Clause 18. The cushioning component of clause 17, wherein: the third barrier sheet is disposed at a distal side of the cushioning component and the first barrier sheet is disposed at a foot-facing side of the cushioning component; and an inflation pressure of the second interior cavity is different than an inflation pressure of the first interior cavity.

Clause 19. The cushioning component of clause 17, wherein: the third barrier sheet is disposed at a distal side of the cushioning component and the first barrier sheet is disposed at a foot-facing side of the cushioning component; the core portions tether the first barrier sheet to the second barrier sheet such that a vertical height of the bladder at the core is less than a vertical height of the bladder at the sidewall portion; a concavity at an outer surface of the first barrier sheet defines at least a portion of a footbed; and the third barrier sheet is relatively flat in comparison to the second barrier sheet.

Clause 20. A method of manufacturing a cushioning component for a wearable article, the method comprising: disposing blocker ink on opposing first and second sides of at least one polymeric sheet; placing the at least one polymeric sheet between a first barrier sheet and a second barrier sheet; wherein the at least one polymeric sheet includes a core and a sidewall surrounding an outer perimeter of the core and decoupled from the core; and thermally bonding: the core to opposing inner surfaces of the first barrier sheet and the second barrier sheet at a plurality of bonds at areas of the at least one polymeric sheet at which the blocker ink is not disposed to tether the first barrier sheet to the second barrier sheet; and the sidewall to first barrier sheet at a first peripheral bond and to the second barrier sheet at a second peripheral bond, the sidewall and the barrier sheets enclosing an interior cavity that extends between the opposing inner surfaces to define a bladder.

Clause 21. The method of clause 20, the method further comprising: prior to the thermally bonding, cutting a slot through the at least one polymeric sheet to decouple the core from the sidewall, wherein an outer perimeter of the core is defined by the slot and is inward of the slot, and the sidewall is outward of the slot.

Clause 22. The method of clause 20, wherein placing the at least one polymeric sheet between a first barrier sheet and a second barrier sheet includes folding the sidewall with a fold extending inward toward the outer perimeter of the core.

Clause 23. The method of clause 20, wherein the wearable article is an article of footwear, and further comprising: disposing the cushioning component in a sole structure of an article of footwear.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A cushioning component for a wearable article, the cushioning component comprising:

a bladder including a first barrier sheet and a second barrier sheet defining an interior cavity between opposing inner surfaces of the first barrier sheet and the second barrier sheet;

a core including at least one polymeric sheet traversing the interior cavity between and directly bonded to the opposing inner surfaces of the first barrier sheet and the second barrier sheet at a plurality of bonds to tether the first barrier sheet to the second barrier sheet; and a sidewall comprising at least one polymeric sheet disposed around an outer perimeter of the core and comprising at least one sidewall inner surface directly bonded to an inner surface of the first barrier sheet at a first peripheral bond and to an inner surface of the second barrier sheet at a second peripheral bond to enclose the interior cavity and retain a gas in the interior cavity, the at least one polymeric sheet of the core disposed in the interior cavity and decoupled from the sidewall, and the at least one polymeric sheet of the core displaced from the opposing inner surfaces by gas at unbonded areas of the at least one polymeric sheet.

2. The cushioning component of claim 1, wherein the plurality of bonds are arranged such that the gas in the interior cavity is in fluid communication around the at least one polymeric sheet of the core without the at least one polymeric sheet of the core creating any sealed chambers within the bladder that are not in fluid communication with the interior cavity.

3. The cushioning component of claim 1, wherein the sidewall is a single polymeric sheet.

4. The cushioning component of claim 3, wherein:

the sidewall is in a first position when the interior cavity is in an uninflated state and in a second position when the interior cavity is in an inflated state; and the sidewall is relatively folded inward toward the core in the first position and extends relatively vertically around the interior cavity in the second position.

5. The cushioning component of claim 1, wherein:

the wearable article is an article of footwear; and the cushioning component is included in a sole structure of the article of footwear.

6. The cushioning component of claim 5, wherein:

the cushioning component extends in each of a heel region of the article of footwear, a midfoot region of the article of footwear, and a forefoot region of the article of footwear; and the sidewall has a greater height in the heel region than in the forefoot region.

7. The cushioning component of claim 5, wherein the interior cavity is a first interior cavity, and the cushioning component further comprises:

a third barrier sheet bonded to the second barrier sheet at an additional peripheral bond, the second barrier sheet and the third barrier sheet defining a second interior cavity between an outer surface of the second barrier sheet and an inner surface of the third barrier sheet; and wherein the first interior cavity and the second interior cavity are fluidly isolated from one another by the second barrier sheet.

8. The cushioning component of claim 7, wherein:

the third barrier sheet is disposed at a distal side of the cushioning component and the first barrier sheet is disposed at a foot-facing side of the cushioning component; and an inflation pressure of the second interior cavity is different than an inflation pressure of the first interior cavity.

9. The cushioning component of claim 7, wherein:

the third barrier sheet is disposed at a distal side of the cushioning component and the first barrier sheet is disposed at a foot-facing side of the cushioning component;

the core tethers the first barrier sheet to the second barrier sheet such that a vertical height of the bladder at the core is less than a vertical height of the bladder at the sidewall;

a concavity at an outer surface of the first barrier sheet defines at least a portion of a footbed; and the third barrier sheet is relatively flat in comparison to the second barrier sheet.

10. The cushioning component of claim 1, wherein:

the at least one polymeric sheet of the core includes a first polymeric sheet and a second polymeric sheet, the first polymeric sheet of the core disposed between the first barrier sheet and the second polymeric sheet, and the second polymeric sheet of the core disposed between the first polymeric sheet and the second barrier sheet such that a first side of the first polymeric sheet of the core faces the inner surface of the first barrier sheet, a second side of the first polymeric sheet of the core faces a first side of the second polymeric sheet, and a second side of the second polymeric sheet of the core faces the inner surface of the second barrier sheet; and the at least one polymeric sheet of the sidewall includes a first polymeric sheet and a second polymeric sheet, the first polymeric sheet of the sidewall bonded to the first barrier sheet at the first peripheral bond, the second polymeric sheet of the sidewall bonded to the second barrier sheet at the second peripheral bond, and the first polymeric sheet of the sidewall bonded to the second polymeric sheet of the sidewall at a third peripheral bond disposed along the sidewall between the first peripheral bond and the second peripheral bond.

11. The cushioning component of claim 10, wherein:

the first side of the first polymeric sheet of the core is directly bonded to the inner surface of the first barrier sheet at a first set of bonds of the plurality of bonds, the second side of the second polymeric sheet of the core is directly bonded to the inner surface of the second barrier sheet at a second set of bonds of the plurality of bonds, and the second side of the first polymeric sheet of the core is directly bonded to the first side of the second polymeric sheet of the core at a third set of bonds of the plurality of bonds.

12. The cushioning component of claim 10, wherein:

the sidewall is in a first position when the interior cavity is in an uninflated state and in a second position when the interior cavity is in an inflated state;

in the second position, the first polymeric sheet of the sidewall and the second polymeric sheet of the sidewall extend relatively vertically between the first barrier sheet and the second barrier sheet in comparison to the first position with the third peripheral bond extending outward of the outer perimeter of the core and separated therefrom by a gap.

13. A cushioning component for a wearable article, the cushioning component comprising:

a bladder including a first barrier sheet and a second barrier sheet defining an interior cavity between opposing inner surfaces of the first barrier sheet and the second barrier sheet;

a first polymeric sheet and a second polymeric sheet disposed between the first barrier sheet and the second barrier sheet and each including a core portion and a sidewall portion decoupled from the core portion and extending along an outer perimeter of the core portion;

wherein the core portion of the first polymeric sheet is bonded to the inner surface of the first barrier sheet and to a first side of the core portion of the second polymeric sheet at a first plurality of bonds, the core portion of the second polymeric sheet is bonded to the inner surface of the second barrier sheet at a second plurality of bonds and to a second side of the core portion of the first polymeric sheet at a third plurality of bonds, the core portion of the first polymeric sheet and the core portion of the second polymeric sheet together traversing the interior cavity and tethering the first barrier sheet to the second barrier sheet; and wherein the sidewall portion of the first polymeric sheet comprises a sidewall first inner surface bonded to the inner surface of the first barrier sheet at a first peripheral bond, the sidewall portion of the second polymeric sheet comprises a sidewall second inner surface bonded to the inner surface of the second barrier sheet at a second peripheral bond, and the sidewall portion of the first polymeric sheet and the sidewall portion of the second polymeric sheet are bonded to one another at a third peripheral bond such that the sidewall portions and the first and second barrier sheets together enclose the interior cavity and retain a gas in the interior cavity, the first polymeric sheet of the core portion and the second polymeric sheet of the core portion displaced from the opposing inner surfaces of the first barrier sheet and the second barrier sheet by the gas at unbonded areas of the core portion of the first polymeric sheet and the core portion of the second polymeric sheet.

14. The cushioning component of claim 13, wherein the first plurality of bonds, the second plurality of bonds, and the third plurality of bonds are arranged such that the gas in the interior cavity is in fluid communication around the core portion of the first polymeric sheet and the core portion of the second polymeric sheet without the core portion of the first polymeric sheet and the core portion of the second polymeric sheet creating any sealed chambers within the bladder that are not in fluid communication with the interior cavity.

15. The cushioning component of claim 13, wherein:

the wearable article is an article of footwear; and the cushioning component is included in a sole structure of the article of footwear.

16. The cushioning component of claim 15, wherein:

the cushioning component extends in each of a heel region of the article of footwear, a midfoot region of the article of footwear, and a forefoot region of the article of footwear; and the sidewall portion has a greater height in the heel region than in the forefoot region.

17. The cushioning component of claim 15, wherein the interior cavity is a first interior cavity, and the cushioning component further comprises:

a third barrier sheet bonded to the second barrier sheet at an additional peripheral bond, the second barrier sheet and the third barrier sheet defining a second interior cavity between an outer surface of the second barrier sheet and an inner surface of the third barrier sheet; and wherein the first interior cavity and the second interior cavity are fluidly isolated from one another by the second barrier sheet.

18. The cushioning component of claim 1, wherein the at least one sidewall inner surface comprises a first portion facing towards the inner surface of the first barrier sheet and the first peripheral bond comprises a first thermal bond directly between the first portion of the at least one sidewall inner surface and the inner surface of the first barrier sheet; and wherein the at least one sidewall inner surface comprises a second portion facing towards the inner surface of the second barrier sheet and the second peripheral bond comprises a second thermal bond directly between the second portion of the at least one sidewall inner surface and the inner surface of the second barrier sheet.

19. The cushioning component of claim 13, wherein a portion of the sidewall first inner surface faces towards the inner surface of the first barrier sheet and the first peripheral bond comprises a first thermal bond between the portion of the sidewall first inner surface and the inner surface of the first barrier sheet; and wherein a portion of the sidewall second inner surface faces towards the inner surface of the second barrier sheet and the second peripheral bond comprises a second thermal bond between the portion of the sidewall second inner surface and the inner surface of the second barrier sheet.

20. The cushioning component of claim 19, wherein the third peripheral bond comprises a portion of an outer surface of the first polymeric sheet bonded to a portion of an outer surface of the second polymeric sheet.

* * * * *